US008033878B2

(12) United States Patent
Shibayama et al.

(10) Patent No.: US 8,033,878 B2
(45) Date of Patent: Oct. 11, 2011

(54) VESSEL SPEED CONTROL SYSTEM FOR SMALL PLANING BOAT AND SMALL PLANING BOAT UTILIZING THE SAME

(75) Inventors: Susumu Shibayama, Shizuoka (JP); Mitsuyoshi Nakamura, Shizuoka (JP); Yoshimasa Kinoshita, Shizuoka (JP)

(73) Assignee: Yamaha Hatsudoki Kabushiki Kaisha, Iwata-shi (JP)

( * ) Notice: Subject to any disclaimer, the term of this patent is extended or adjusted under 35 U.S.C. 154(b) by 392 days.

(21) Appl. No.: 12/145,337

(22) Filed: Jun. 24, 2008

(65) Prior Publication Data

US 2010/0240266 A1 Sep. 23, 2010

Related U.S. Application Data

(60) Provisional application No. 60/945,986, filed on Jun. 25, 2007.

(51) Int. Cl.
*B63H 21/21* (2006.01)

(52) U.S. Cl. ..... 440/87; 440/1; 701/21

(58) Field of Classification Search ..... 440/1, 84, 440/87, 2; 701/21
See application file for complete search history.

(56) References Cited

U.S. PATENT DOCUMENTS 5,074,810 A * 12/1991 Hobbs et al. ..... 440/2
5,092,260 A * 3/1992 Mardikian ..... 114/285
5,110,310 A * 5/1992 Hobbs ..... 440/1
5,369,360 A * 11/1994 Amyot ..... 324/174
5,606,253 A * 2/1997 Boucher et al. ..... 324/174
6,184,784 B1 * 2/2001 Shibuya ..... 340/438
6,353,781 B1 * 3/2002 Spivak ..... 701/21
6,517,394 B2 * 2/2003 Ozawa ..... 440/1
6,551,152 B2 * 4/2003 Matsuda et al. ..... 440/1
6,790,107 B2 * 9/2004 Tanaka ..... 440/1
7,491,104 B2 * 2/2009 Walser et al. ..... 440/87
2002/0016112 A1 * 2/2002 Matsuda ..... 440/87
2002/0155766 A1 * 10/2002 Hattori ..... 440/1

FOREIGN PATENT DOCUMENTS

JP 2002-180861 6/2002

* cited by examiner

*Primary Examiner* — Lars A Olson
(74) *Attorney, Agent, or Firm* — Knobbe, Martens, Olson & Bear, LLP

(57) ABSTRACT

A speed control system for a small planing boat can comprise a speed sensor to detect a vessel speed of a boat body, a speed information storing unit on which data of a previously set maximum speed limit of the boat body is stored, and a speed control device for controlling the cruising speed of the boat body not to exceed the maximum speed limit based on a result of a correlation between the cruising speed and the maximum speed limit. The speed control device can comprise a revolution speed sensor, a revolution speed acquiring unit and a revolution speed control unit. The speed control device can also work in conjunction with an intake air mass amount control device which can include an electronically-controlled throttle valve, an air mass amount acquiring unit and a throttle opening degree control unit.

23 Claims, 22 Drawing Sheets

10
17
114
116
115
A'
111
113
112
47
A 111
113
113

111
112
112

114
115
116
(d)
FLOW-OUT DIRECTION
JET DIRECTION
111
112

VESSEL SPEED CONTROL SYSTEM FOR SMALL PLANING BOAT AND SMALL PLANING BOAT UTILIZING THE SAME

The present application is based on and claims priority under 35 U.S.C. §119(e) to U.S. Provisional Application No. 60/945,986, filed on Jun. 25, 2007, the entire contents of which is expressly incorporated by reference herein.

BACKGROUND OF THE INVENTIONS

1. Field of the Inventions

The present inventions relate to a control system for a boats, such as planing boats with water-jet-propulsion systems.

2. Description of the Related Art

Small planing boats, such as "personal watercraft" are often used for sports and leisure. Boats of this type of are usually small planing boats, driven by a rearward discharge of a jet of water drawn from a water intake port provided to an under surface of the boat body, then pressurized and accelerated by a water-jet pump.

Meanwhile, maximum speed limits for small planing boats is, in some local regions, limited. Thus, manufacturers may be required to install a vessel speed (cruising speed or boat speed) limiter in order to prevent the boat from exceeding a predetermined maximum speed limit.

Some boats include user-adjustable vessel speed control systems, also known as "cruise assist systems," such as those disclosed in Japanese Patent Document JP2002-180861A1. In this patent, the vessel speed control system includes a cruise assist operation device provided on a steering bar, and according to the operation of this device, the engine of the boat is maintained at an engine speed stored in a memory device.

However, in such speed control systems in which vessel speed is controlled based only on the engine speed stored in memory, the actual vessel speed varies with the shape and weight of the boat body and conditions of the engine. Other conditions such as a direction of the wind, current, loading weight (for example, a body weight and the number of people boarding the boat), etc. also affect the vessel speed.

Thus, this type of speed control system suffers from problems in that the vessel speed is not satisfactorily controlled when conditions are changed. In addition, the maximum speed limit for marine vessels is different for different countries and/or different regions.

Therefore, in order to cope with these situations, one solution is to change conditions of the boat body without changing the set conditions of the speed control system. For example, the shape of the boat body can be changed to have a larger resistance to water in order not to exceed the regulatory speed. However, if such maximum speed control technique is adopted, larger resistances are also generated during acceleration, so that output power of the engine is not always effectively utilized, and thus can be unsatisfactory to users.

SUMMARY OF THE INVENTIONS

In accordance with an embodiment, a vessel speed control system can be provided for controlling a vessel speed of a small planing boat, a boat body of the small planing boat being driven by thrust force generated by jetting liquid from a nozzle supported by a portion of the boat body and driven by an internal combustion engine. The vessel speed control system can comprise vessel speed detection means for detecting a speed of the boat body. Speed information storing means in which previously set maximum speed limit data of the boat body can be stored. Additionally, vessel speed control means can be provided for controlling the speed of the boat body so as not to exceed the maximum speed limit based on a result of a correlation, the correlation being performed by correlating a speed detected by the vessel speed detection means with the maximum speed limit stored on the speed information storing means.

In accordance with another embodiment, a vessel speed control system for a small planing boat can comprise a vessel speed detection device configured to detect a speed of a body of a boat. A speed information storing device can be configured to store a maximum speed limit data of the boat body. Additionally, a vessel speed control device can be configured to control the speed of the boat body so as not to exceed the maximum speed limit based on a result of a correlation, the correlation being performed by correlating a speed detected by the vessel speed detection means with the maximum speed limit stored on the speed information storing device.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
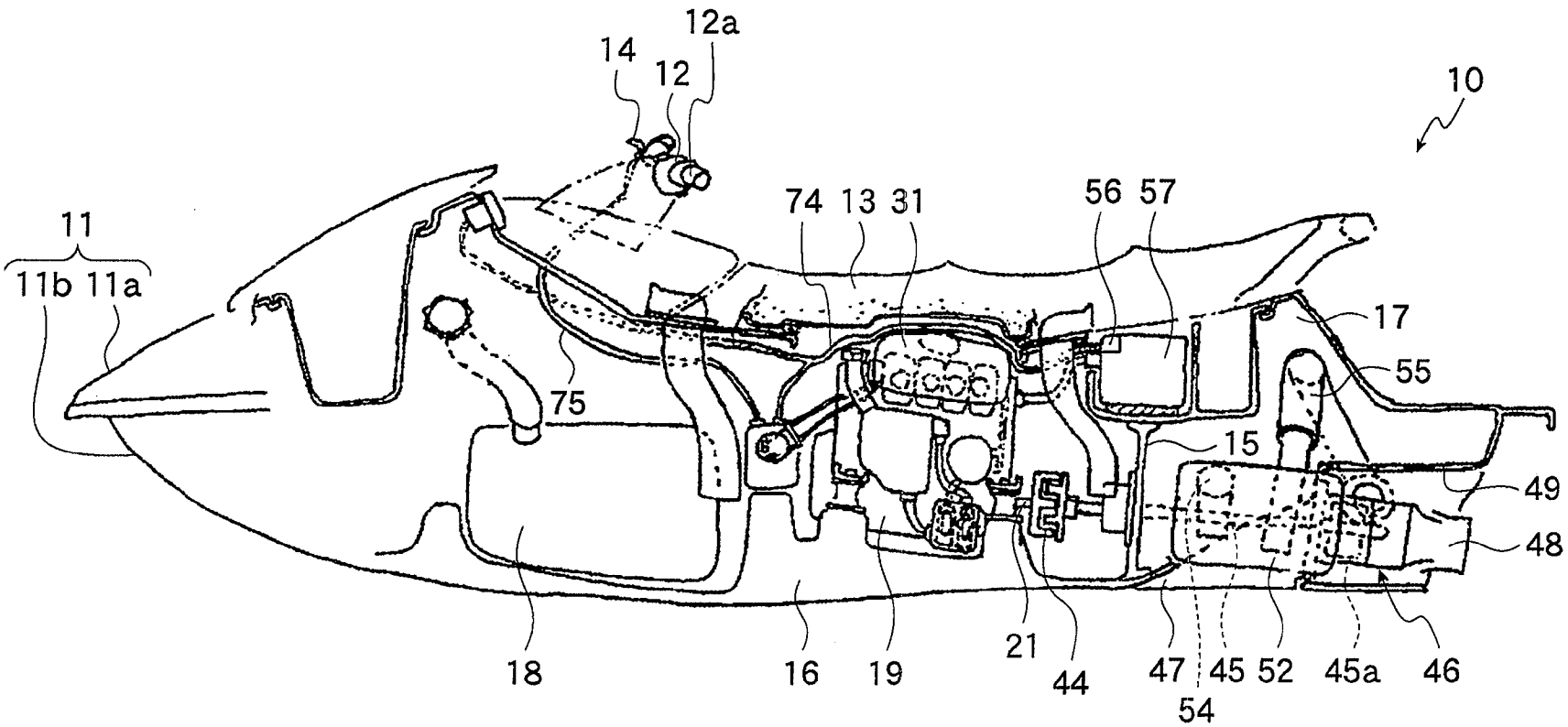
FIG. 1 is a side view showing an inside of a small planing boat with a speed control system according to a first embodiment.
Figure 2:
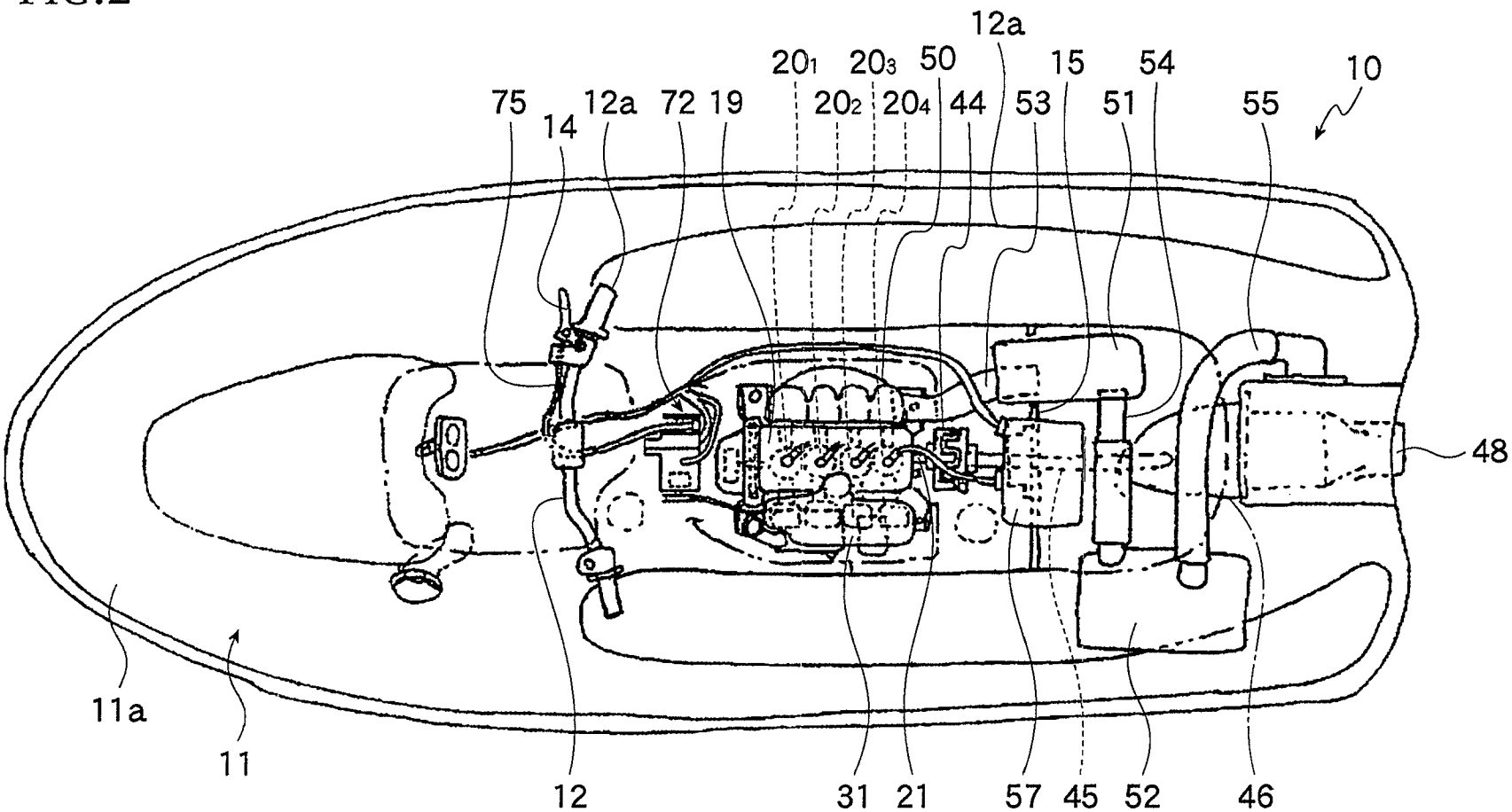
FIG. 2 is a plan view showing an inside of the small planing boat of FIG. 1.

With reference to FIGS. 1 and 2, a small planing boat 10 can include a speed control system. The various embodiments of the control systems are disclosed in the context of a small water vehicle because they have particular utility in this context. However, the control systems and methods disclosed herein can be used in other contexts, such as, for example, but without limitation, outboard motors, inboard/outboard motors, and for engines of other vehicles including land vehicles.

The boat 10 can comprise a boat body 11 having a deck 11*a* and a hull 11*b*. A steering handle 12 can be provided at about a center of the top of the body and a seat 13 can be disposed rearwardly therefrom. At a place near one of grips 12*a* of the steering handle 12, a throttle lever 14 can be supported rotatably to the grip 12*a* through a shaft and movable back and forth with respect to the circumferential direction of the grip 12*a*. Thus, the locations of the steering handle 12 and throttle lever 14 can define the operator's or driver's area of the boat 10.

The inside of the boat body 11 can be divided by a bulkhead 15 into an engine compartment 16 and a pump chamber 17. In the engine compartment 16, a fuel tank 18 for accommodating fuel can be provided at a bottom front side portion of the boat body 11, and in the engine compartment 16, the engine 19 can be supported on a bottom center portion of the boat body 11.

Figure 3:
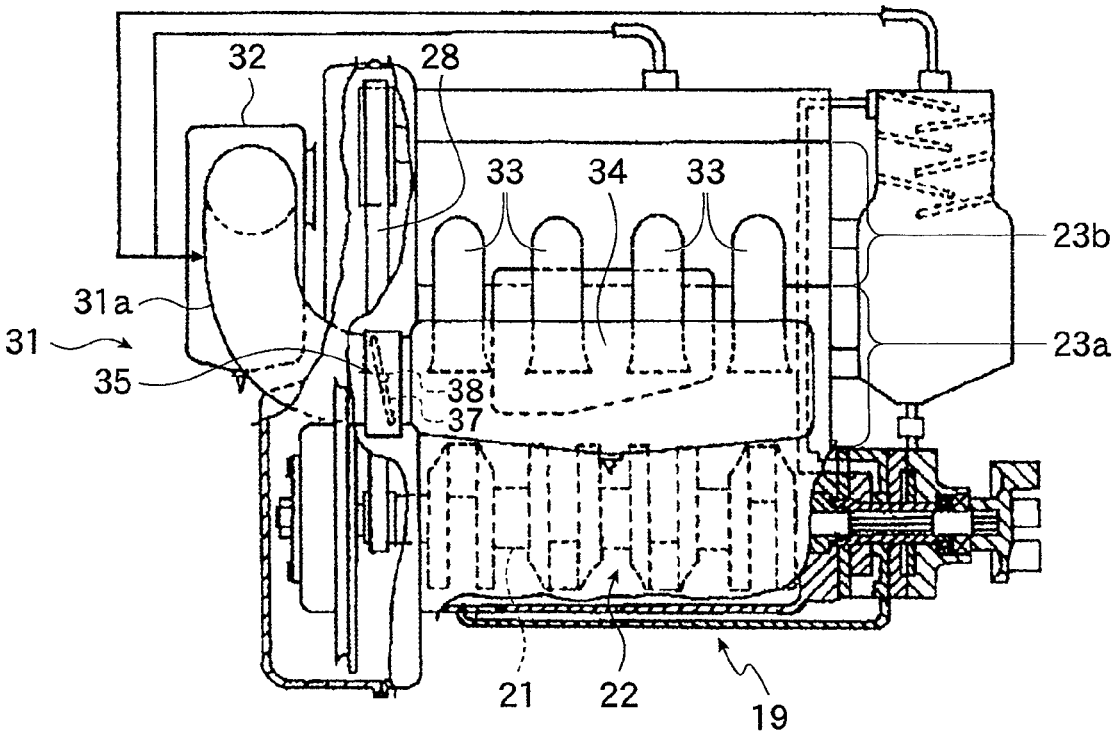
FIG. 3 is a sectional view showing an engine of the small planing boat of FIG. 1.

An engine 19 can be a 4-cylinder 4-cycle type engine and can have four cylinders 201, 202, 203, 204 which are arranged in an anteroposterior direction. As shown in FIG. 3, the engine 19 can also have a cylinder block 23*a* and a cylinder head 23*b* disposed to an upper portion of a crank case 22 in which a crankshaft 21 can be accommodated. In the cylinder block 23*a*, a piston 25 can be connected to the crankshaft 21 by way of a connecting rod 24, and thus can be accommodated vertically movable. A vertical movement of the piston 25 can be transmitted to the crankshaft 21 to produce a rotational movement.

Figure 5:
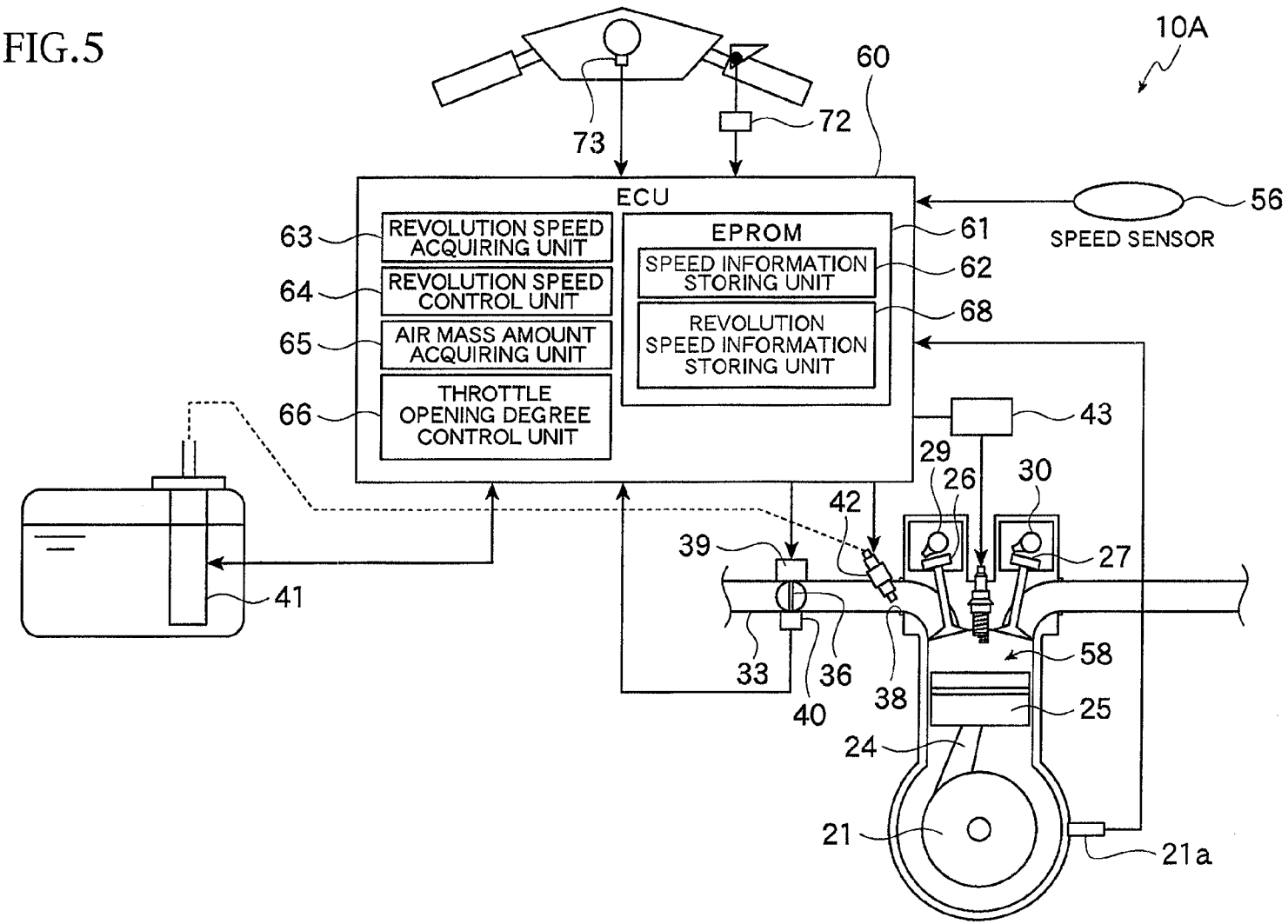
FIG. 5 is a functional block diagram of a speed control system of the small planing boat of FIG. 1.

As shown in FIG. 5, a combustion chamber 58 can be formed on an upper side of the piston 25 in the cylinder block 23*a*. The cylinders 201, 202, 203, 204 each can have the same configuration. Thus, they are referred to as a "cylinder 20" except where there is a need to distinguish them from each other.

The crankshaft 21 can have a revolution speed sensor 21*a*, which can serve as a "revolution speed detection means" for detecting revolution speed of the engine 19.

Each cylinder 20 can have an air-intake valve 26 and an exhaust valve 27. The air-intake valve 26 and exhaust valve 27 can each be driven by an air-intake cam shaft 29 and an exhaust cam shaft 30 which are connected to a crankshaft 21 through a timing belt 28. On the port side of the engine 19, an air-intake device 31 can be arranged, and on the starboard side, an exhaust system 50 can be arranged.

The air-intake device 31 can comprise four intake pipes 33 each of which can be formed as an intake air passage 38 for feeding air into a combustion chamber 58, an air inlet chamber 34 connected to an upstream end of an intake pipe 33, a throttle body 35 connected to an upstream end of an air inlet chamber 34 and an air-intake silencer 32 connected to the throttle body 35 through an air intake duct 31*a*.

The air-intake silencer 32 guides air from the outside of the boat 10 into the throttle body 35 through an air-intake duct 31*a*. In the air-intake passage of the throttle body 35, a circular disc-like electronically-controlled throttle valve 36 can be attached to a valve shaft 37 and thus can be rotatably supported together with the valve shaft 37.

Figure 4:
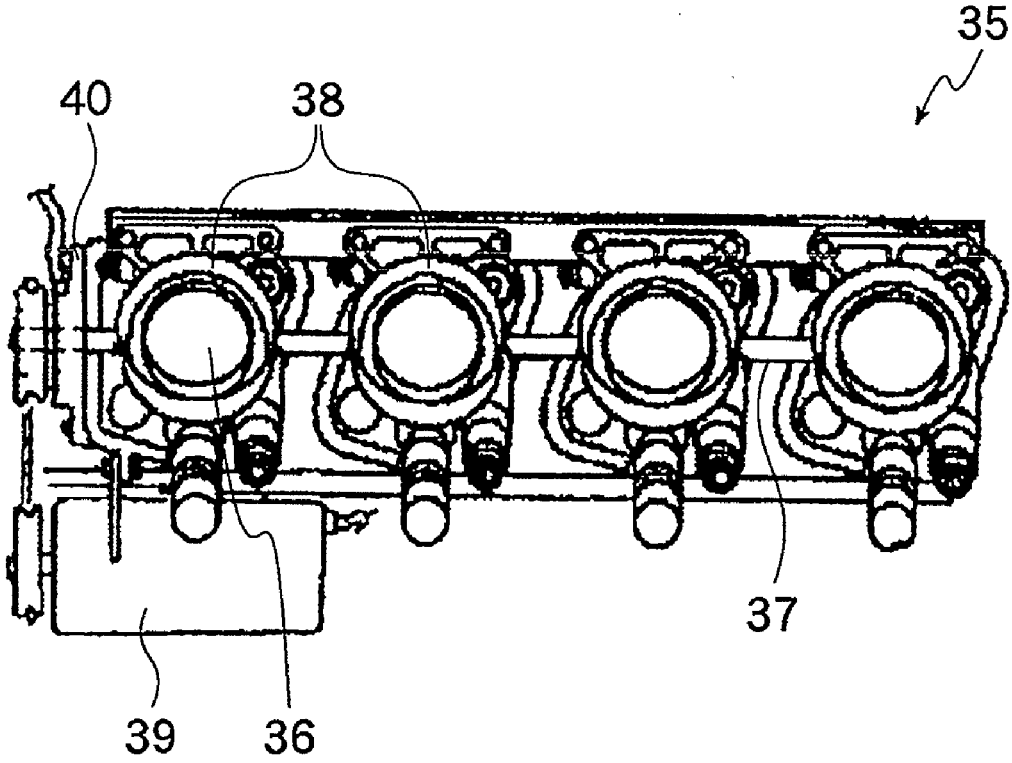
FIG. 4 is a front view showing a throttle body of an engine of the small planing boat of FIG. 1.

As shown in FIG. 4, in each intake air passage 38 of the throttle body 35, the circular disk-like electronically-controlled throttle valves 36 on the valve shaft 37 can be rotatably supported together with the valve shaft 37. In addition, near the throttle body 35, a motor 39 can be provided and when the motor 39 is driven, the driving force of the motor can be transmitted to the valve shaft 37 so that the electronically-controlled throttle valve 36 can be rotated together with the valve shaft 37. Thereby, an opening degree of the electronically-controlled throttle valve 36 can be adjusted and an air flowing into the combustion chamber 58 can be controlled. In addition, on the valve shaft 37, a valve position sensor 40 can be provided for detecting the opening degree (rotation angle of the valve shaft 37) of the electronically-controlled throttle valve 36.

Fuel can be supplied into the engine 19 from a fuel tank 18 through a fuel pump 41 and an injector. By the operation of the fuel pump 41, fuel supplied from the fuel tank 18 can be turned into a misty state by an injector 42 and injected into the cylinder 20. During injection, the fuel can be mixed with an air supplied from an air-intake apparatus 31 and can be sent to the combustion chamber 58 as a fuel-air mixture.

In addition, the engine 19 can be provided with an ignition coil 43 as an ignition device. The fuel-air mixture can be ignited by the ignition of this ignition coil 43, and the piston 25 can be vertically moved to rotationally drive the crankshaft 21.

From the rear portion of the engine 19, an impeller shaft 45 coupled with the crankshaft 21 through a coupling 44 extends into a rear side pump chamber 17 through a bulkhead 15 and a casing 49. This impeller shaft 45 can be coupled with an impeller 45*a* provided inside the propelling machinery 46 which can be provided at the stern of the boat body 11. Torque of the crankshaft 21 generated by the driving of the engine 19 can be transmitted to the impeller 45*a* to rotate the impeller 45*a*.

The propelling machinery 46 can comprise a water intake port 47 provided at a bottom portion of the boat body 11 and a nozzle 48 provided at the stern. Liquid (water, seawater etc.) from the water intake port 47 can be jetted from the nozzle 48 by the rotation of the impeller 45*a*, to generate propulsion force (thrust force) of the boat body 11. This propelling machinery 46 can be attached to the bottom portion of the boat body 11 in an isolated state from the boat body 11 by the casing 49. This type of propelling machinery 46 is often referred to as a "jet pump."

Toward the rear side of the engine 19, an exhaust system 50 can be disposed. This exhaust system 50 can comprise an exhaust chamber 51 having a bent tube and a tank-like water lock 52, etc. The exhaust chamber 51 can have a one end portion which can be communicated with an exhaust passage 53 provided at one side of the engine 19 and can have the other end portion extending backward and further extending downward to penetrate through the bulkhead 15.

A rear end portion of the exhaust chamber 51 can be communicated with a front portion of the water lock 52 through a hose 54.

From an upper surface of the rear portion of this water lock 52, an exhaust gas pipe 55 can extend rearwardly. An upstream end portion of the exhaust gas pipe 55 can be communicated with an upper surface of the water lock 52 and a downstream side thereof extends once upward and then extends downward and rearward, and a downstream end portion goes through the casing 49 and merges into the nozzle 48 of the propelling machinery 46.

A speed sensor 56, which can serve as "speed detecting means" can be provided at a portion of the boat body 11 of the small planing boat 10. This speed sensor 56 can have a function of a GPS (Global Positioning System) to measure the speed of the boat body 11 including the ground speed by the transmission with the GPS satellite.

In addition, on the engine compartment 16 side of the bulkhead 15 of the small planing boat 10, an electric box 57 can be disposed, in which an ECU (Electronic Control Unit) 60 which can be a component of the speed control system 10A of the small planing boat can be provided.

As shown in FIG. 5 which shows a functional block diagram, this ECU 60 having an EPROM (Erasable Programmable Read Only Memory) 61 can be provided, on which various programs are stored and a storage can be erasable and rewritable. On the EPROM 61, various programs, various registers and flags, etc, which can be used in executing specific programs are stored. Further, in addition to the EPROM 61, the ECU 60 can have a CPU (Central Processing Unit) for executing various computations according to the programs, etc., a RAM (Random Access Memory) for functioning as a working area of the CPU, a timer, etc. (not shown).

The EPROM 61 can have a speed information storing unit 62 and a revolution speed (or "engine speed") information storing unit 68 which can serve as "speed information storing means." In the speed information storing unit 62, data of the previously set maximum speed limit of the boat body 11 can be stored, and in the revolution speed information storing unit 68, data of the previously set maximum revolution speed limit which can be a revolution speed of the engine 19 when the boat body 11 cruises at the maximum speed limit, can be stored. As used herein, the term "maximum speed limit" can refer to the maximum speed the boat can achieve when operated by a driver positioned in the driver's area during normal operation of the boat 10, and while any user-adjustable reduced performance modes are not active. In other words, the "maximum speed limit" refers to the maximum speed the boat can achieve when the user adjusts all of the user-adjustable portions of the boat to achieve maximum speed. The devices, means, and methods disclosed herein as defining or storing the "maximum speed limit" are configured so that they are not user-adjustable, although they may be adjusted by a mechanic or other authorized technician. This is because manufacturers may be required by government regulation or otherwise to construct the boat so that it can go no faster than a specified speed, which can be different for different countries or regions in which the boat may be sold. Thus, for example, the EPROM 61 can be configured to be erasable or re-writable only with a device given to authorized mechanics, with a password, for example, entered via a device connectable to the ECU 60, or otherwise.

The ECU 60, which can serve as functioning means, according to the results of computation at the CPU using various hardware and programs stored on the EPROM 61, can comprise a revolution speed acquiring unit 63, which can serve as "surplus revolution speed acquiring means," a revolution speed control unit 64, which can serve as "revolution speed control means," an air mass acquiring unit 65, which can serve as "surplus air mass amount acquiring means" and a throttle opening degree control unit 66, which can serve as "throttle opening degree control means."

The revolution speed acquiring unit 63 can be configured to acquire, by calculation based on a previously set predetermined equation, a surplus revolution speed value (or surplus value in revolution speed, described later) or an insufficient revolution speed value (or insufficient value in revolution speed, described later). The revolution speed control unit 64 can be configured to control the revolution speed of the internal combustion engine based on the surplus revolution speed value or the insufficient revolution speed value.

The air mass amount acquiring unit 65 can be configured to acquire, by calculation based on previously-set predetermined equation, a surplus air mass amount value (described later) or an insufficient air mass amount value (described later) over an air mass amount necessary to be supplied into the engine 19. The throttle opening degree control unit 66 decreases or increases the opening degree of the electronically-controlled throttle valve 36 based on an acquired surplus or insufficient air mass amount value.

Further, ECU 60 can be connected to predetermined devices including a valve position sensor 40, an accelerator position sensor 72 and a steering angle sensor 73 to acquire signals from these switches and equipments, and then drives the engine 19 and a motor 39 based on these signals.

The accelerator position sensor 72 can be composed of a resistor (e.g. a variable resistor) provided near the engine 19 and connected to a throttle lever 14 through a throttle cable 75. Thus, this sensor can detect a voltage according to a resistance value which varies based on an operation of the throttle lever 14. This sensor thus can detect an operation amount of the throttle lever 14 from the change in the detected voltage value. This accelerator position sensor 72 can be connected to the ECU 60 through a wiring 74. The steering angle sensor 73 can be an angle sensor provided to a handle shaft (not shown) of the steering handle 12 and detects a rotating angle of the handle shaft (not shown). For instance, a steering load sensor etc. which can detect a steering state of the steering handle 12 may be provided instead of this steering angle sensor 73.

The small planing boat 10, in some embodiments, can have "speed control means" for controlling the cruising speed of the boat body 11 not to exceed the maximum speed limit based on a result of a correlation obtained by collating a vessel speed detected by the speed sensor 56 with the maximum speed limit stored on the speed information storing unit 62. The "speed control means" of some embodiments can comprise "output power control means" for controlling the output power of the engine 19 based on a result of correlation between the vessel speed and the maximum speed limit. The "output power control means" can include a configuration comprising a revolution speed sensor 21*a*, a revolution speed acquiring unit 63, and a revolution speed control unit 64, and "intake air mass control means" comprising a electronically-controlled throttle valve 36, an air mass amount acquiring unit 65, and a throttle opening degree control unit 66.

Figure 6A:
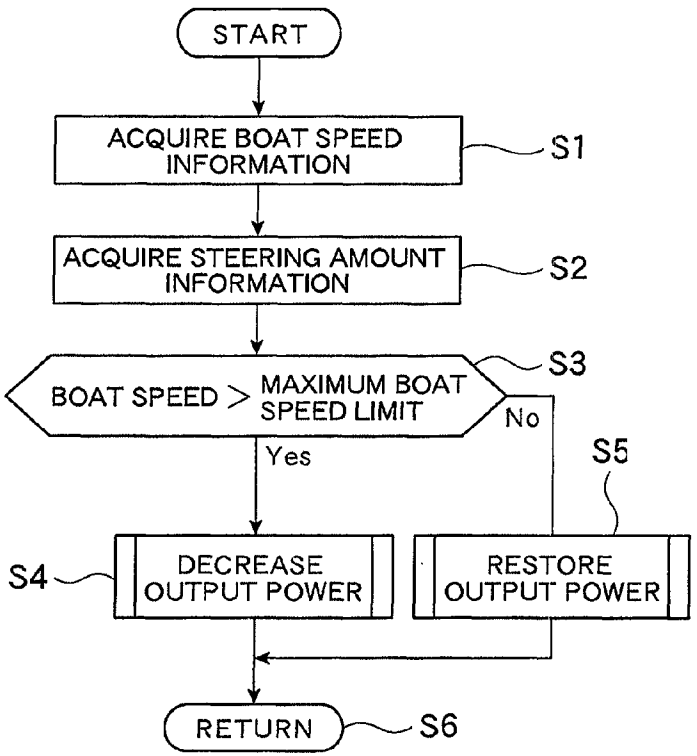
FIG. 6A is a flow chart showing a general procedure of a speed control using the speed control system of the small planing boat of FIG. 1.
Figure 6B:
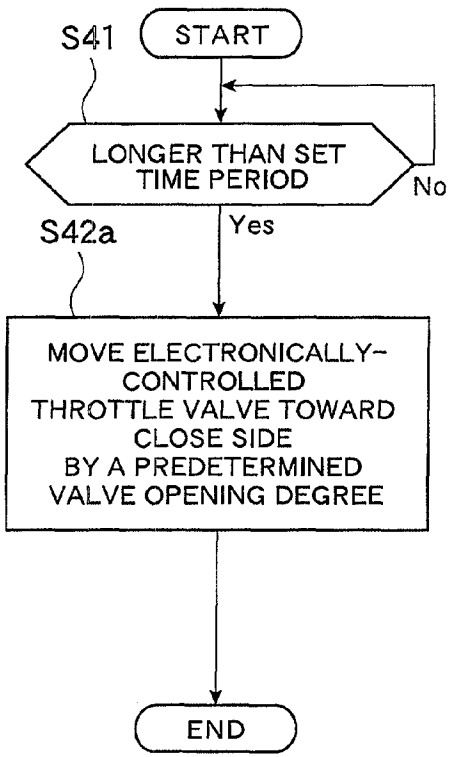
FIG. 6B is a flow chart showing an output power control of the engine of the speed control system of the small planing boat of FIG. 1 when the vessel speed of the small planing boat exceeds the maximum speed limit.
Figure 6C:
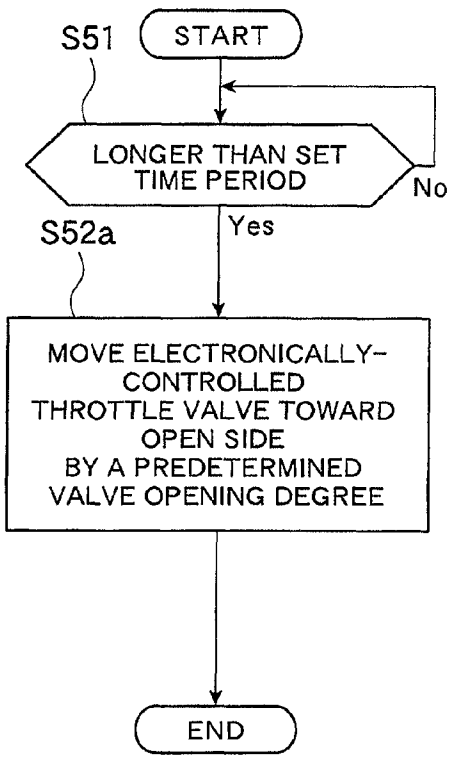
FIG. 6C is a flow chart showing a control for restoring the output power of the engine.

FIGS. 6A, 6B and 6C are flowcharts showing procedures of speed control in accordance with some embodiments. FIG. 6A is a flowchart showing an exemplary speed control basic operation.

As shown in the flowchart, at first, when the ECU 60 is started up and the small planing boat 10 begins to move, the ECU 60 receives detected signals sent from the speed sensor 56, the revolution speed sensor 21*a*, the valve position sensor 40, and the accelerator position sensor 72.

The ECU 60 acquires vessel speed information based on a detected signal from the speed sensor 56 (Step S1), and acquires steering angle information based on the detecting signals from the steering angle sensor 73 (Step S2). Then "output power control means" of the ECU 60 performs a correlation between the speed of the boat body 11 based on the vessel speed information as well as the steering angle information and the maximum speed limit data stored on the EPROM 61.

As a result of the correlation, when the value of the vessel speed is higher than a data of the maximum speed limit stored on the speed information storing unit 62 of the EPROM 61 ("Yes" at Step S3), the "output power control means" of ECU 60 controls the output power (Step S4) of the engine 19.

The output power control of the engine 19 in Step S4 can be carried out based on the flowchart in FIG. 6B. As shown in the flowchart, at first the "output power control means" of the ECU 60 confirms whether a state in which the vessel speed value is larger than the data of the maximum speed limit, lasts for a previously predetermined time period or not in order to preclude a signal (for example a noise), detected only for a short period of time, from the objects to be controlled ("No" at Step S41). When the vessel speed value is found to be larger than the data of the maximum speed limit for the predetermined time period ("Yes" at Step S41), the "output power control means" of the ECU 60 performs a control to move the electronically-controlled throttle valve 36 to the closing side by a predetermined opening degree based on a value detected by the valve position sensor 40 (Step S42*a*). More precisely, the "output power control means" of the ECU 60 performs a control comprising procedures of a1 to d1 shown below.

$a_1$: The revolution speed acquiring unit 63 acquires the surplus revolution speed value. For example, the revolution speed acquiring unit 63 performs a correlation between the detected signal of the revolution speed sensor 21*a* and the data of the maximum speed limit stored on the revolution speed information storing unit 68 of the EPROM 61, and then acquires by calculating the surplus revolution speed value, or an excess revolution speed in the current revolution speed of the engine 19, over the revolution speed of the engine 19 when the boat body 11 cruises at the maximum speed limit.

$b_1$: The air-mass amount acquiring unit 65 acquires, by calculation based on the acquired surplus revolution speed value, a surplus air mass amount value or an excess intake air mass amount in the current intake air mass amount flowing into the engine 19 over the intake air mass amount necessary to be supplied into the engine 19 when the boat body 11 is driven at the maximum speed limit.

$c_1$: The throttle opening degree control unit 66 performs an operation to move the electronically-controlled throttle valve 36 to a closing side based on the acquired surplus intake air mass amount value. This operation can be performed by either setting a moving distance (or an opening degree) of the electronically-controlled throttle valve 36 toward the closing side or by setting a time period to move the electronically-controlled throttle valve 36 toward the closing side. When the operation is performed in terms of the moving distance, the larger the surplus revolution speed value is, the larger the moving distance is set. And when the operation is performed in terms of the time period, the larger the surplus revolution speed value is, the longer the time period is set.

$d_1$: When the moving distance is set in the step $c_1$, the throttle opening degree control unit 66 moves the electronically-controlled throttle valve 36 for a certain time period toward the closing side by a set certain moving distance based on a value detected by the valve position sensor 40 to decrease the opening degree to thereby decrease an air mass amount flowing through the intake air passage 38. On the other hand, when the time period is set in the step $c_1$, the throttle valve opening degree control unit 66 decreases the opening degree by moving the electronically-controlled throttle valve 36 for a set time period by a certain amount of opening degree toward the closing side thereof based on the value detected by the valve position sensor 40 to decrease the air mass amount flowing through the intake air passage 38.

The output power control (Step S4) can be completed by the completion of the $a_1$ to $d_1$ procedures. In addition, after the $a_1$ procedure, the revolution speed control unit 64 can control the revolution speed of the engine 19 (to make the revolution speed lower than a set specific revolution speed which can be set as a revolution speed when the boat cruises at the maximum vessel speed limit) based on the value of the surplus revolution speed acquired by the revolution speed acquiring unit 63 (this procedure can be applied to a stage after procedure of $a_2$ to $a_7$ in other later embodiments of the present invention).

On the other hand, as the result of the correlation, when the value of the vessel speed is less than the data of the maximum vessel speed limit stored on the speed information storing unit 62 of the EPROM 61 ("No" in Step S3), the "output power control means" of the ECU 60 performs a control to restore the output power of the engine 19 (Step S5). "To restore" means to make the output power of the engine 19 more than the normal output power with respect to the operation amount of the throttle lever 14 when the output power of the engine 19 is found to be less than the normal output power with respect to the operation amount of the operation of the throttle lever 14 as the result of the processing of Step 4 and also means to make the output power of the engine 19 at a normal level corresponding to the amount of the operation of the throttle lever 14 when the processing procedure of Step S4 is not performed.

The control to restore the output power of the engine 19 at Step S5 can be performed based on a flow chart as shown in FIG. 6C. As shown in the same flow chart, like in Step S41, the "output power control means" of the ECU 60 confirms whether a state in which the vessel speed value is lower than the maximum vessel speed limit lasts for a previously predetermined time period or not. When the state lasts for the predetermined time period ("Yes" at Step S51), the "output power control means" of the ECU 60 performs a control to move the electronically-controlled throttle valve 36 to the opening side by a predetermined opening degree based on a value detected by the valve position sensor 40 (Step S52*a*). More precisely, the "output power control means" of the ECU 60 performs controlling procedures of $e_1$ to $h_1$ shown below.

$e_1$: The revolution speed acquiring unit 63 acquires an insufficient revolution speed value. More precisely, the revolution speed acquiring unit 63 performs a correlation between a detected signal detected by the revolution speed sensor 21*a* and a stored revolution speed data stored on the revolution speed information storing unit 68 of the EPROM 61, and acquires the insufficient revolution speed value or an insufficient value of the revolution speed in the current revolution speed of the engine 19 over the revolution speed of the engine 19 at the time the boat body 11 is driven at the maximum speed limit.

$f_1$: The air mass amount acquiring unit 65 acquires, by calculation based on the acquired insufficient revolution speed value, an insufficient air mass amount value or an insufficient intake air mass amount value in the current intake air mass amount supplied into the engine 19 over the intake air mass amount necessary to be supplied into the engine 19 when the boat body 11 is driven at the maximum speed limit.

$g_1$: The throttle opening degree control unit 66 performs a setting to move the electronically-controlled throttle valve 36 toward the opening side based on the acquired insufficient intake air mass value. The setting can be performed by setting a moving distance (or an opening degree) of the electronically-controlled throttle valve 36 toward the opening side or by setting a time period to move the electronically-controlled throttle valve 36 toward the opening side. When the setting is performed in terms of the moving distance, the larger the insufficient revolution speed value is, the larger the moving distance is set. When the setting is performed in terms of the time period, the larger the insufficient revolution speed value is, the longer the time period is set.

$h_1$: When the moving distance is set in the step $g_1$, the throttle opening degree control unit 66 moves the electronically-controlled throttle valve 36 for a certain time period toward the opening side by a certain moving distance which can be set based on the value detected by the valve position sensor 40 to increase the opening degree, to thereby increase an air mass amount flowing through the intake air passage 38. On the other hand, in the step $g_1$, when the time period is set, the throttle opening degree control unit 66 increases the opening degree by moving the electronically-controlled throttle valve 36 by a certain amount of opening degree toward the opening side for a set time period which is set based on the value detected by the valve position sensor 40, to thereby increase the air mass amount flowing through the intake air passage 38.

The output power control (Step S5) for restoring the output power can be completed by the completion of the $e_1$ to $h_1$ procedures. In addition after the procedure $e_1$, the revolution speed control unit 64 can control the revolution speed of the engine 19 (to adjust the revolution speed of the engine to a specific revolution speed which is required to keep the boat at the maximum vessel speed limit) based on the value of the insufficient revolution speed acquired by the revolution speed acquiring unit 63 (this procedure can be applied to a stage after the procedures of $e_2$ to $e_7$ of other later embodiments of the present invention).

As shown in FIG. 6A, when Step S4 and Step S5 are completed, the Step S1 and the subsequent Steps are repeated (Step S6).

As mentioned above, in some embodiments of the small planing boat 10, the "speed control means" performs a correlation between the vessel speed detected by the speed sensor 56 and the maximum vessel speed limit stored on the speed information storing unit 62 and controls the cruising speed of the boat body 11 not to exceed the maximum vessel speed limit based on the result of the correlation. The "speed control means" comprises the "output power control means" to control the output power of the engine 19 based on the result of the correlation between the vessel speed and the maximum boats speed limit. Accordingly, the maximum speed of the small planing boat 10 can be kept below a certain speed without adding anything special to or modifying the physical configuration, etc. of the boat body 11 of the small planing boat 10.

Accordingly, the speed of the small planing boat 10 can be kept accurately below the predetermined maximum speed with simple structural configuration.

In some embodiments, the "output power control means" can comprise the revolution speed sensor 21*a* for detecting the revolution speed of the engine 19, the revolution speed acquiring unit 63 for acquiring, by calculation etc., the surplus revolution speed value over a revolution speed of the engine 19 necessary to make the vessel speed of the small planing boat 10 reach a predetermined speed when the vessel speed exceeds the maximum vessel speed limit as a result of the correlation between the vessel speed and the maximum vessel speed limit, and the revolution speed control unit 64 for controlling the revolution speed of the engine 19 based on the acquired surplus revolution speed value. Therefore the maximum speed of the small planing boat 10 can be kept below a certain speed by controlling the revolution speed of the engine 19 which directly affects the output power of the engine 19. Accordingly, highly accurate speed control to keep the vessel speed of the small planing boat 10 below a set maximum vessel speed can be performed accurately.

In some embodiments, the "speed control means" comprises the "intake air mass amount control means" for decreasing the amount of air flowing into the combustion chamber 58 of the engine 19. Therefore, when the output power is to be controlled, deterioration of the combustion state and occurrence of vibration in the combustion chamber 58 can be suppressed, being able to keep the vessel speed of the small planing boat 10 below the set maximum vessel speed, smoothly.

In some embodiments, the "intake air mass amount control means" can comprise the electronically-controlled throttle valve 36 whose opening degree can be controlled by the electronic means disposed in the intake air passage 38 which feeds air mass into the combustion chamber 58 of the engine 19, the air mass amount acquiring unit 65 for acquiring a surplus air mass amount value by calculation, etc. over the air mass amount necessary to be supplied into the engine 19 to make the vessel speed of the small planing boat 10 reach a predetermined speed when the cruising speed of the boat body 11 exceeds the maximum speed limit as a result of the correlation between the vessel speed and the upper vessel speed limit, and the throttle opening degree control unit 66 for decreasing the opening degree of the electronically-controlled throttle valve 36 based on the acquired surplus air mass amount value. Therefore, the air mass amount to be supplied into the combustion chamber 58 can be controlled accurately by electronically controlling the opening degree of the throttle valve. Accordingly, deterioration of the combustion state and occurrence of vibration can be suppressed, being able to realize a control to keep the vessel speed below the set maximum vessel speed smoothly, easily and accurately.

In some embodiments, the valve position sensor 40 for detecting an opening degree of the electronically-controlled throttle valve 36 can be provided, and the air mass amount value to be supplied into the combustion chamber 58 can be decreased with the decrease in the opening degree of the electronically-controlled throttle valve 36 based on the detected value of the valve position sensor 40. The intake air mass value and the surplus air mass value can be easily acquired based on a state of the electronically-controlled throttle valve 36 which controls the intake air mass amount. Accordingly a speed control to keep the vessel speed below the set maximum speed can be realized easily and accurately.

In some embodiments, the speed sensor 56 is a speed sensor of a GPS type, so that the speed including the ground speed can be accurately detected, being able to detect an accurate speed detection.

In some embodiments, the data of the maximum vessel speed limit and the data of the maximum revolution speed limit are stored on the rewritable EPROM 61 of the speed information storing unit 62 and the revolution speed information storing unit 68. Accordingly, the data of the maximum vessel speed limit and the data of the maximum revolution speed limit can be amended if necessary. Setting and changing of the speed control for each small planing boat having different shipping destination and setting and adjustment for each small planing boat 10 can be performed easily and precisely.

In some of the embodiments described above, the revolution speed acquiring unit 63 and the intake air mass acquiring unit 65 calculate the revolution speed value and the intake air mass amount value using the predetermined equations. However, the revolution speed value and the intake air mass amount value can be acquired based on a table data stored on the EPROM 61 instead of using the predetermined equations.

Figure 7:
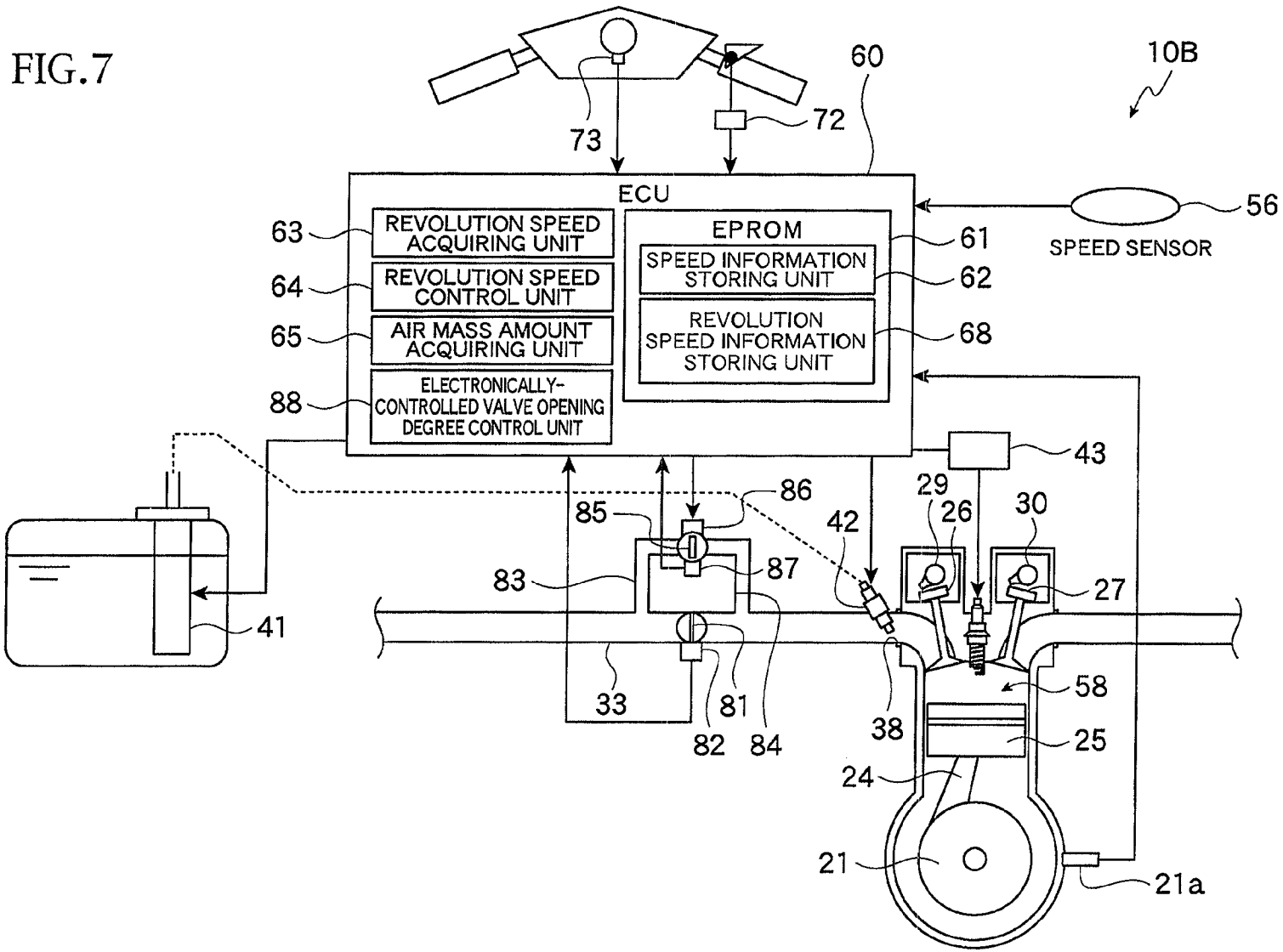
FIG. 7 is a functional block diagram of the speed control system of a small planing boat according to a second embodiment.

FIG. 7 shows additional embodiments. As shown in the functional block diagram in FIG. 7, in a speed control system 10B of the small planing boat, an air intake pipe 33 of the engine 19 can have a mechanical throttle valve 81 connected to an accelerator (not shown) by a wire (not shown) instead of the electronically-controlled throttle valve 36. To a valve shaft (not shown) of this mechanical throttle valve 81, a valve position sensor 82 for detecting an opening degree (rotation angle of the valve shaft) can be attached. A bypass tube 83 can be branched from an upper stream side of the intake pipe 33 and disposed upper than a place where the mechanical throttle valve 81 can be positioned.

The bypass tube 83 can form a bypass passage 84 bypassing the mechanical throttle valve 81 and letting the air flow into the combustion chamber 58. At a portion along the bypass tube 83, an electronically controlled valve 85 can be supported rotatably, movably together with a valve shaft (not shown). Near the electronically controlled valve 85, a motor 86, which can serve as an "actuator" can be provided. When the motor 86 is driven, a motor-generated driving force can be transmitted to the valve shaft (not shown), to rotate the electronically controlled valve 85. Then the throttle opening degree of the electronically controlled valve 85 can be controlled, thus air flowing into the combustion chamber 58 can be controlled. In addition, a valve position sensor 87 for detecting the opening degree (valve shaft rotation angle) of the electronically controlled valve 85 can be provided to the valve shaft (not shown).

To the ECU 60, an electronically-controlled valve-opening-degree control unit 88 as "electronically-controlled valve-opening-degree control means" can be provided instead of the throttle opening-degree control unit 66 of the first embodiment. The electronically-controlled valve opening-degree control unit 88 increases or decreases the opening degree of the electronically controlled valve 85 based on the acquired surplus air mass amount value.

According to the above mentioned configuration, the "intake air mass control means" of this embodiment comprises the electronically controlled valve 85, the air mass amount acquiring unit 65 and the electronically-controlled valve-opening-degree control unit 88. Other configurations are the same as in the first embodiment.

Operational procedures of this embodiment can be the same as of the first embodiment as shown in FIGS. 6A, 6B and 6C. However, an increase ($h_1$ of Step S5) and a decrease ($d_1$ of Step S4) in the opening degree of the electronically controlled valve 85 in the electronically control valve-opening-degree control unit 88 can be controlled based on a premise that the mechanical throttle valve 81 is opened.

As mentioned above, in some embodiments, the "intake air mass control means" comprises the bypass passage 84 which can be provided separately from the intake air passage 38 in which the mechanical throttle valve 81 can be provided and through which air flows into the combustion chamber 58. The bypass passage 84 can be branched from the intake air passage 38 and bypasses the mechanical throttle valve 81 and lets air flow into the combustion chamber 58.

The intake air mass control means can further comprise the electronically controlled valve 85 whose opening degree can be controlled by electronic means, for controlling the air flowing through the bypass passage 84, the motor 86 for driving the electronically controlled valve 85, the air mass amount acquiring unit 65 for acquiring by calculation etc, a surplus air mass amount value over an air mass amount which can be supplied into the engine 19 to make the small planing boat 10 reach a predetermined vessel speed when the cruising speed of the boat body exceeds the maximum vessel speed limit as a result of correlation between the cruising speed of the boat body and the maximum vessel speed limit, and the electronically-controlled valve-opening-degree control unit 88 for decreasing the opening degree of the electronically controlled valve 85 by driving the motor 86 based on the acquired surplus air mass amount value. Therefore, air flowing through the bypass passage 84 can be accurately controlled by the electronically controlled valve 85 provided separately from the mechanical throttle valve 81, so that in the configuration having the mechanical throttle valve 81, the deterioration in the combustion state and the occurrence of vibration etc. can be suppressed and speed control to keep the cruising speed below the set maximum vessel speed can be realized smoothly, easily and accurately.

In some embodiments, the "intake air mass control means" can be used as the mechanical throttle valve 81, but a throttle valve other than the mechanical valves such as electrically controlled throttle valves can be used instead.

Figure 8:
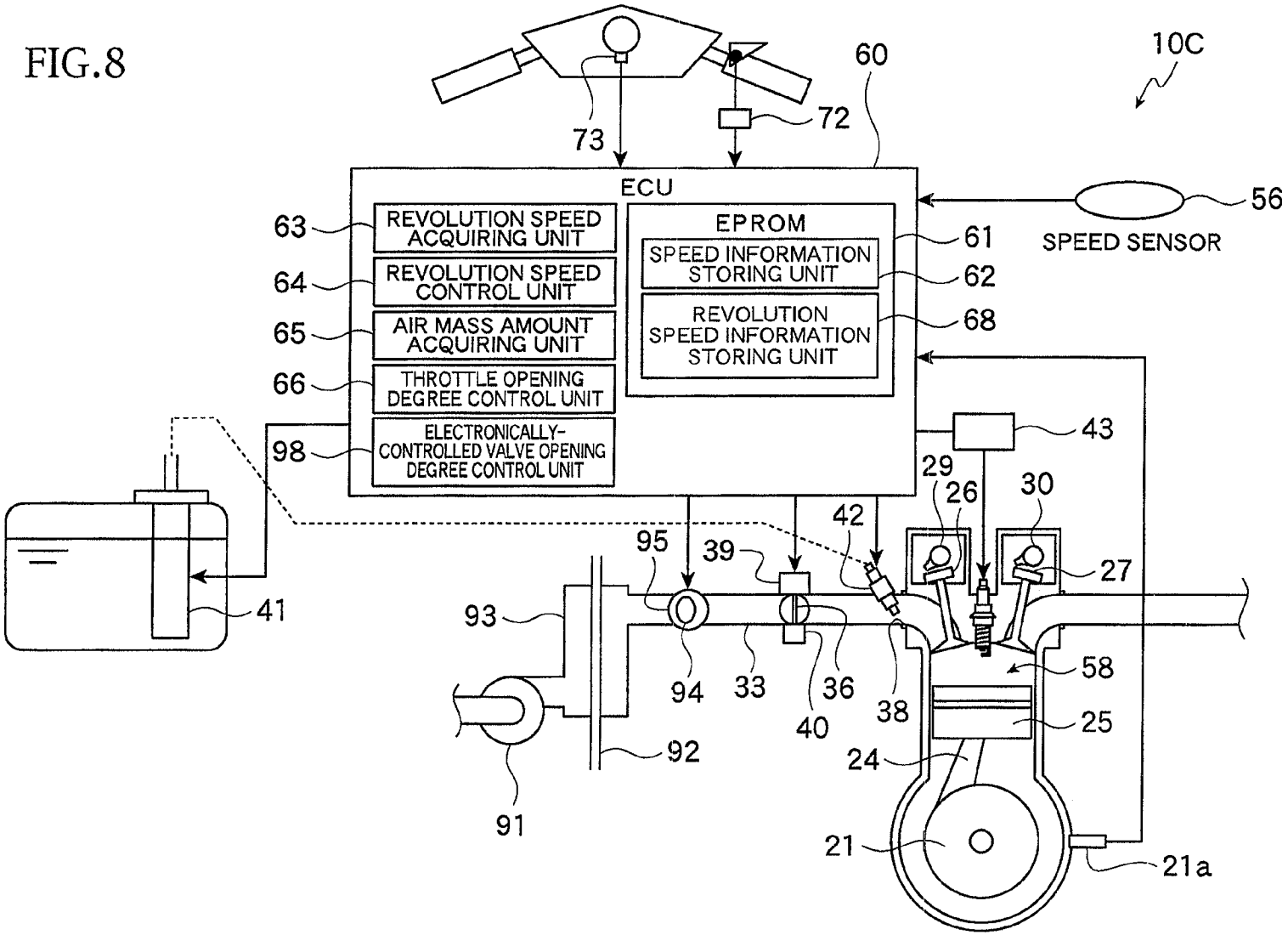
FIG. 8 is a functional block diagram of the speed control system of a small planing boat according to a third embodiment.
Figure 9A:
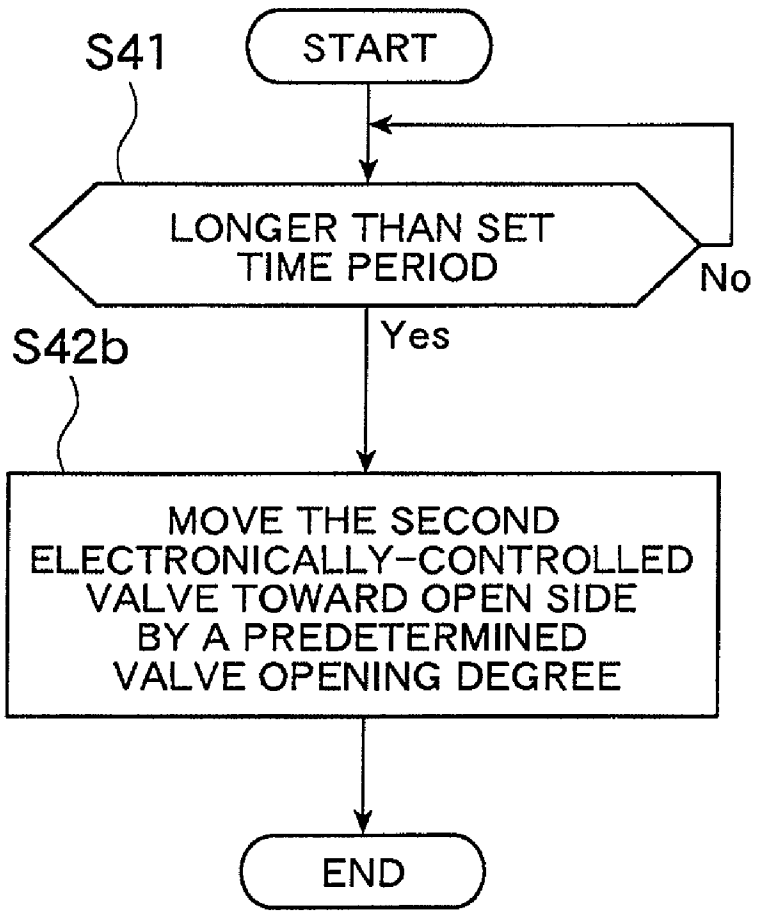
FIG. 9A is a flow chart showing an output power control of the engine of the speed control system of the small planing boat of FIG. 8 when the vessel speed of the small planing boat exceeds the maximum speed limit.
Figure 9B:
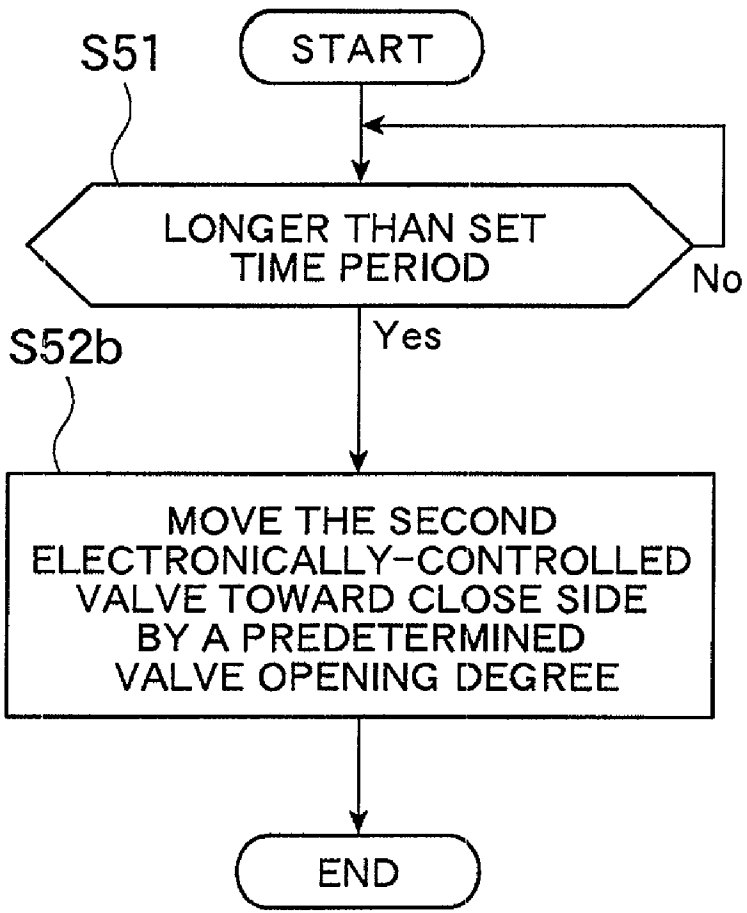
FIG. 9B is a flow chart showing a control for restoring the output power of the engine.

FIGS. 8, 9A and 9B show additional embodiments. As shown in the functional block diagram in FIG. 8, in a speed control system 10C of the small planing boat of this embodiment, an engine 19 can be an engine with a supercharger, which can be provided with a supercharger 91 having a turbine to compress the intake air mass and an inter cooler 93 having a cooled water conduction tube 92 to cool a compressed intake air mass by the supercharger 91. The intercooler 93 can be connected to an air intake pipe 33. The supercharger 91, the intercooler 93 and the air intake pipe 33 form together into an intake air passage 38.

At a portion of the air intake pipe 33, an opening 94 for discharging a certain amount of air passing through the intake air passage 38 into a space other than the combustion chamber 58 of the engine 19 can be formed. To the opening 94, a second electronically controlled valve 95 which can be openable and closeable, is provided. Near the second electronically controlled valve 95, a motor can be disposed. When the motor 96 is driven, the second electronically controlled valve 95 can be opened or closed by the driving force generated by the motor. Thus the opening degree of the throttle of the second electronically control valve 95 can be controlled and the amount of air discharging from the intake air passage 38 to a space other than the combustion chamber 58 can be regulated. In addition, to the valve shaft (not shown), the valve position sensor 97 can be attached to detect the opening degree (rotation angle of the valve shaft) of the second electronically controlled valve 95.

In the ECU 60, in addition to the functional means of the first embodiment, an electronically controlled valve-opening-degree control unit 98, which can serve as "second electronically controlled valve-opening-degree control means" can be provided. The electronically-controlled valve-opening-degree control unit 98 can be configured to increase and decrease the opening degree of the second electronically controlled valve 95 based on the acquired surplus air mass amount value.

According to the configuration mentioned above, the "intake air mass amount control means" of some embodiments can comprise the second electronically controlled valve 95, the air mass amount acquiring unit 65 and the electronically controlled valve-opening-degree control unit 98. Other configurations are the same as in the first embodiment.

Basic procedures of the speed control of this embodiment can be the same as the procedures shown in FIG. 6A. However, instead of Step S42*a* as shown in a flowchart of FIG. 9A, in an output power control (Step S4), the "output power control means" of the ECU 60 can perform a control (Step S42*b*) to move the second electronically controlled valve 95 to the opening side by a predetermined opening degree after a procedure of Step S41. Specifically, the "output power control means" of the ECU 60 can perform procedures of e1 to h1 mentioned above to increase the opening degree of the second electronically controlled valve 95. Thus the opening 94 can be opened to discharge the air in the air intake passage 38 into a space other than the combustion chamber 58 of the engine 19.

On the other hand, as shown in the flowchart of FIG. 9B of this embodiment, in the control (Step S5) in which the output power is restored, after Step S51, instead of the procedure of Step S52*a*, the "output power control means" of the ECU 60 can perform a control (Step S52*b*) to move the second electrically controlled valve 95 toward an opening direction by a predetermined opening degree. For example, the "output power control means" of the ECU 60 can perform a control of the above mentioned a1 to d1 procedures so as to decrease the opening degree of the second electronically controlled valve 95. Thus, the opening degree (or amount) of the opening 94 can be decreased to reduce the amount of air which can be discharged from the intake air passage 38 to a space other than the combustion chamber 58 of the engine 19.

As mentioned above, in some embodiments, the engine 19 can be an engine with a supercharger 91. The supercharger can be provided to the intake air passage 38. The "intake air mass control means" can comprise the electronically controlled throttle valve 36 provided to an intake air passage 38, and the second electronically controlled valve 95 disposed at a downstream side of the intake air passage 38 more downward than a place where the supercharger 91 can be positioned. An opening degree of the controlled valve 95 can be controlled by electronic means.

When the valve 95 is opened, a part (portion) of air flowing through the intake air passage 38 discharged into a space other than the combustion chamber 58. The intake air mass amount control means can further comprise the air mass amount acquiring unit 65 and the electronically-controlled valve-opening-degree control unit 98. The air mass acquiring unit 65 acquires, by calculation etc., a surplus air mass amount value over the air mass amount to be supplied into the engine 19 necessary to make the vessel speed of the small planing boat 10 reach a predetermined speed, when the cruising speed of the boat body 11 exceeds the maximum vessel speed limit as a result of correlation between the cruising speed of the boat body 11 and the maximum vessel speed limit. The electronically-controlled valve-opening-degree control unit 98 increases the opening degree of the second electronically controlled valve 95 based on an acquired surplus air mass amount value. According to the above mentioned intake air mass control means, in the engine with a supercharger, the surplus amount of air in the compressed air is discharged into a space other than the combustion chamber 58 through the second electronically controlled valve 95 so that air amount to be supplied into the combustion chamber 58 is accurately controlled. Accordingly, in an engine with a supercharger, deterioration of combustion state and occurrence of vibration etc. can be suppressed and a speed control to keep the vessel speed below the set maximum speed limit can be performed smoothly, easily and accurately.

In addition, in some embodiments, a throttle valve such as a mechanically controlled throttle valve etc., can be used instead of the electronically controlled type throttle valve 36.

Figure 10:
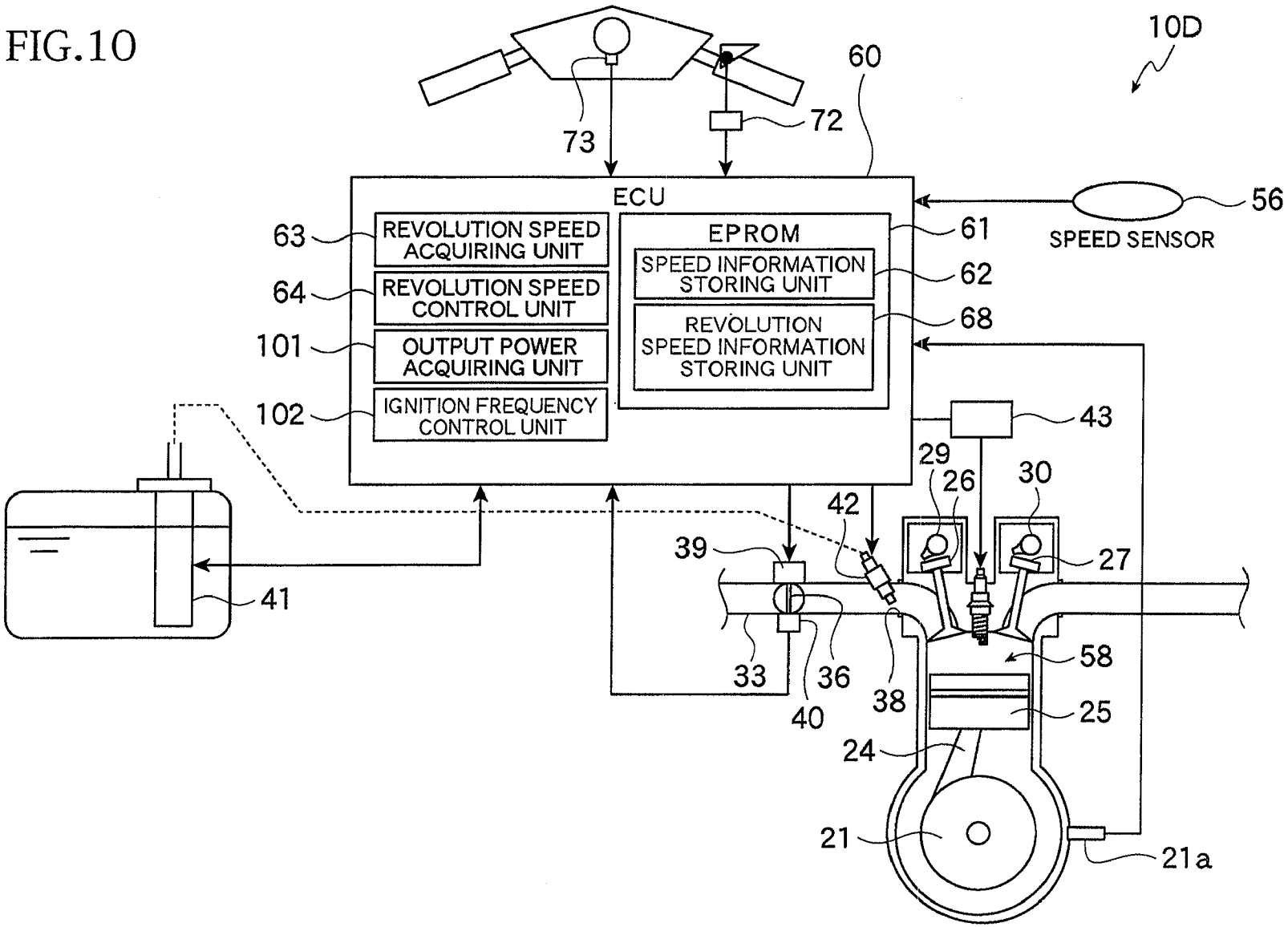
FIG. 10 is a functional block diagram of a speed control system of a small planing boat according to a fourth embodiment.
Figure 11B:
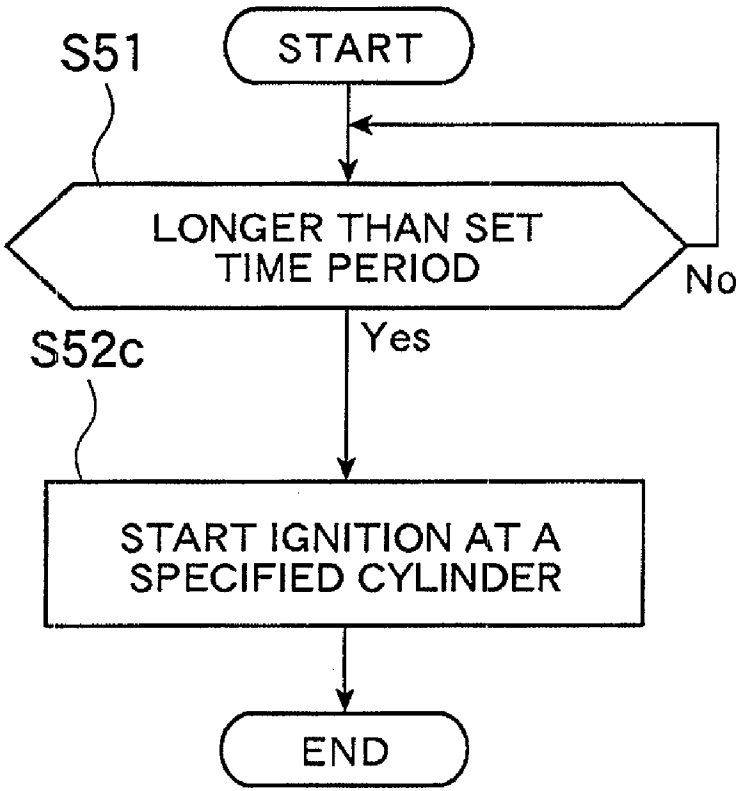
FIG. 11B is a flow chart showing a control for restoring the output power of the engine.
Figure 11A:
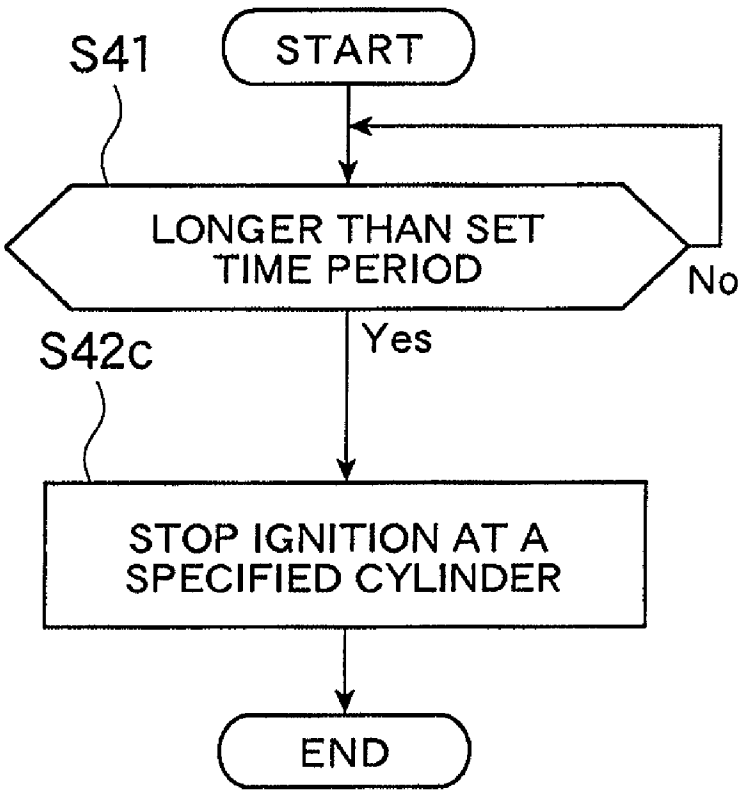
FIG. 11A is a flow chart showing an output power control of the engine of a speed control system of the small planing boat of FIG. 10 when the vessel speed of the small planing boat exceeds a maximum speed limit.

FIGS. 10, 11A and 11B show additional embodiments. As shown in a functional block diagram in FIG. 10, in a speed control system 10D of the small planing boat of some embodiments, an output power acquiring unit 101, which can serve as "surplus output power acquiring means" and an ignition frequency control unit 102, which can serve as "ignition frequency control means" can be provided to the ECU 60 instead of the air mass amount acquiring unit 65 and the throttle opening degree control unit 66. The output power acquiring unit 101 acquires, by calculation based on a previously set predetermined equation, a surplus or an insufficient output power value of the engine 19, over the current output power of the engine 19 necessary to make the boat body 11 reach a maximum vessel speed limit stored on a speed information storing unit 62. The ignition frequency control unit 102 controls the number of ignition or the number of conduction to an ignition coil 43 with respect to a revolution speed of the engine 19, based on an acquired surplus or insufficient output power value of the engine 19.

According to the above mentioned configuration, the small planing boat 10 of this embodiment can have the "ignition state control means" as the "output power control means" for controlling the ignition state of fuel in the combustion chamber 58 of the engine 19. This "ignition state control means" can comprise the output power acquiring unit 101 and the ignition frequency control unit 102. Other configurations are the same as that of the first embodiment.

The operational procedures of this embodiment can be basically the same or similar to some of the above-described embodiments. As shown in the flow chart in FIG. 11A, in an output power control step (Step S4), after the procedure of Step S41, the "ignition state control means" of the ECU 60 performs a control to decrease the number of ignition with respect to the revolution speed of the engine 19 (Step S42*c*). For example, the "output power control means" and the "ignition state control means" of ECU 60 perform controls of a2 to d2 described below.

$a_2$: The revolution speed acquiring unit 63 acquires a surplus revolution speed value, like in the procedure $a_1$ described above.

$b_2$: The output power acquiring unit 101 acquires, by calculation based on the acquired surplus revolution speed value, a surplus output power value of the engine 19 or an excess output power value in the current output power of the engine 19 over the output power of the engine 19 when the boat body 11 cruises at the maximum vessel speed limit.

$c_2$: The ignition frequency control unit 102 performs setting, based on the acquired surplus output power value of the engine 19, to decrease the number of ignition with respect to the revolution speed of the engine 19. For example, when during the normal sailing state, m ignitions (for example m=1) are performed (that is, electric conduction to the ignition coil 43 is performed) per n revolutions (for example n=2) of the engine 19, ignition of ignition coil 43 of a specific cylinder, for example, a cylinder 201, is made stopped (that is, ignition is not carried out at a normal ignition timing which is performed when the boat is in normal sailing condition). That is, m×p−1 ignitions are set to be carried out. Setting can be carried out in such a manner that the more the surplus output power value becomes, the greater the number of cylinder 20 which decreases the number of ignition is set.

$d_2$: The ignition frequency control unit 102 decreases the number of ignitions with respect to the revolution speed of the engine 19 by performing electrical conduction to the ignition coil 43 based on the set conditions. After the completion of the above $a_2$ to $d_2$ procedures, the output power control (Step S4) is completed.

As shown in the flowchart in FIG. 11B, in an output power restoring control (Step S5) of some embodiments, after the procedure of Step S51, instead of the procedure of Step S52*a*, the "ignition state control means" of the ECU 60 performs a control to increase the number of ignition with respect to the revolution speed of the engine 19 (Step S52*c*). for example, the "output power control means" and the "ignition state control means" can perform a control of $e_2$ to $h_2$ described below.

$e_2$: The revolution speed acquiring unit 63 can acquire a surplus revolution speed value like the above mentioned procedure $e_1$.

$f_2$: The output power acquiring unit 101 can acquire, by calculation based on the acquired surplus revolution speed value, an insufficient output power value of the engine 19, or an insufficient output power value in the current output power of the engine 19 over the output power of the engine 19 when the boat body 11 cruises at the maximum vessel speed limit.

$g_2$: The ignition frequency control unit 102 can perform a setting to restore the number of ignition with respect to the revolution speed of the engine 19 based on the acquired insufficient output power value of the engine 19. For example, when during the normal sailing state, m ignitions (for example m=1) are performed (that is, electrical conduction to the ignition coil 43 is performed) per n revolutions (for example n=2) of the engine 19. m×p or m×p+1 ignitions are set to be performed per n×p revolution (for example p=10) of the engine 19 at a specific cylinder, for example, cylinder 201. Setting is performed such that the more the insufficient output power value becomes, the more the number of cylinders 20 to be increased in the number of ignition is set.

$h_2$: The ignition frequency control unit 102 can increase the number of ignitions with respect to the revolution speed of the engine 19 by performing electric conduction to the ignition coil 43 based on the setting conditions.

By the completion of procedures from $e_2$ to $h_2$, the control of restoring the output power (Step S5) is completed.

As mentioned above, in some embodiments, the "output power control means" can be provided with the "ignition state control means" for controlling the ignition state of the fuel in the combustion chamber 58 of the engine 19 so that ignition state control of fuel in the combustion chamber 58 of the engine 19 can be designed to be simple and speed control for keeping the vessel speed below the set maximum vessel speed can be carried out smoothly. In addition, many conventional ignition control systems for the engine 19 can be used together with this configuration of the present invention, being able to simplify its configuration and to decrease the manufacturing cost.

In some embodiments, the "ignition state control means" can comprises the output power acquiring unit 101 for acquiring, by calculation etc., based on the result of correlation between the vessel speed and the maximum vessel speed limit, a surplus output power value in a current output power of the engine 19, over the output power of the engine 19 necessary to make the cruising speed of the small planing boat 10 reach a predetermined speed and the ignition frequency control unit 102 for decreasing the number of ignition with respect to the revolution speed of the engine 19 based on the acquired surplus output power value. Accordingly, adopting a simple configuration to control the ignition frequency and by simply controlling the ignition state of the fuel in the combustion chamber 58 of the engine 19, the vessel speed can be accurately controlled below the set maximum vessel speed.

Figure 12:
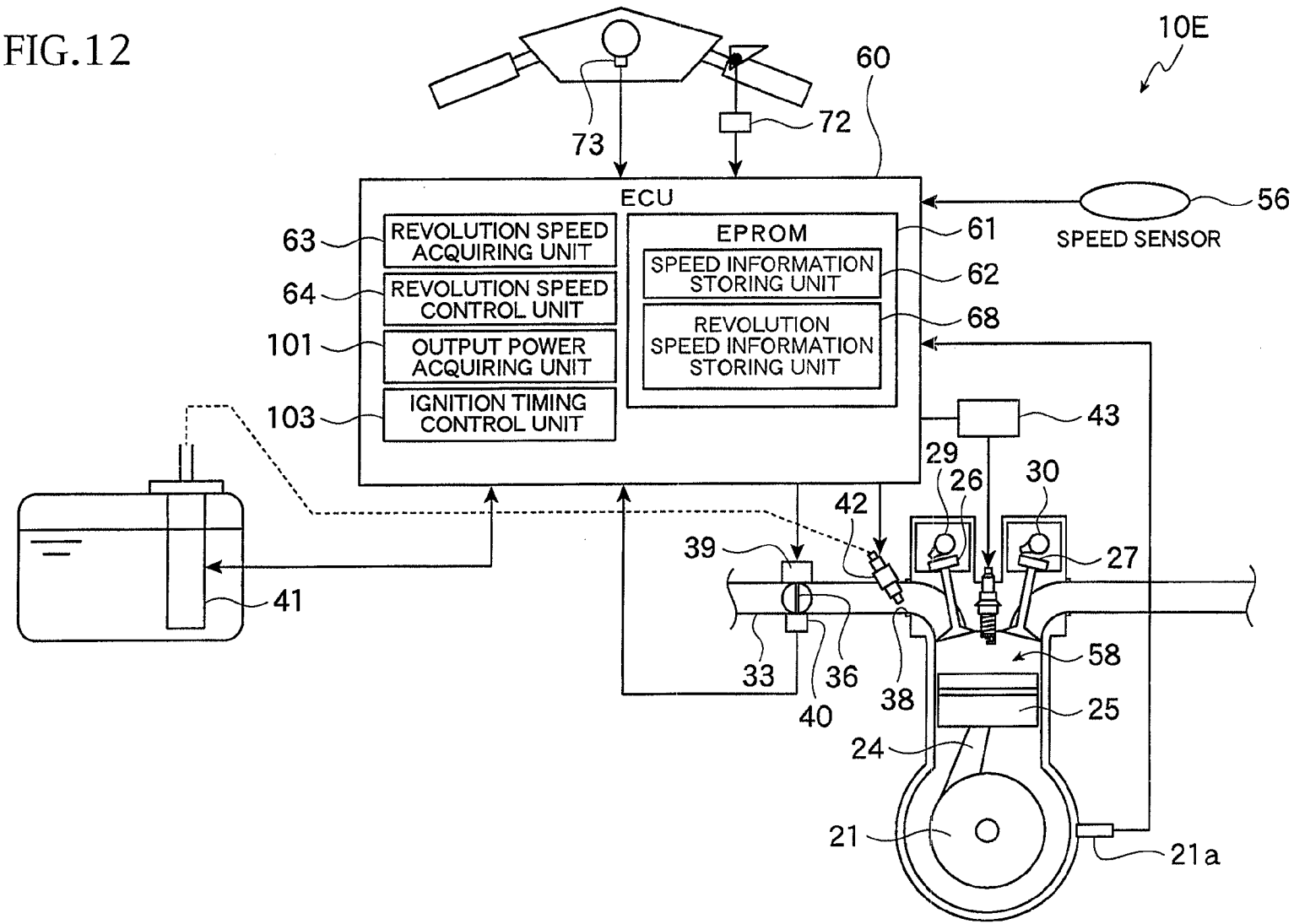
FIG. 12 is a functional block diagram of a speed control system of a small planing boat according to a fifth embodiment.
Figure 13B:
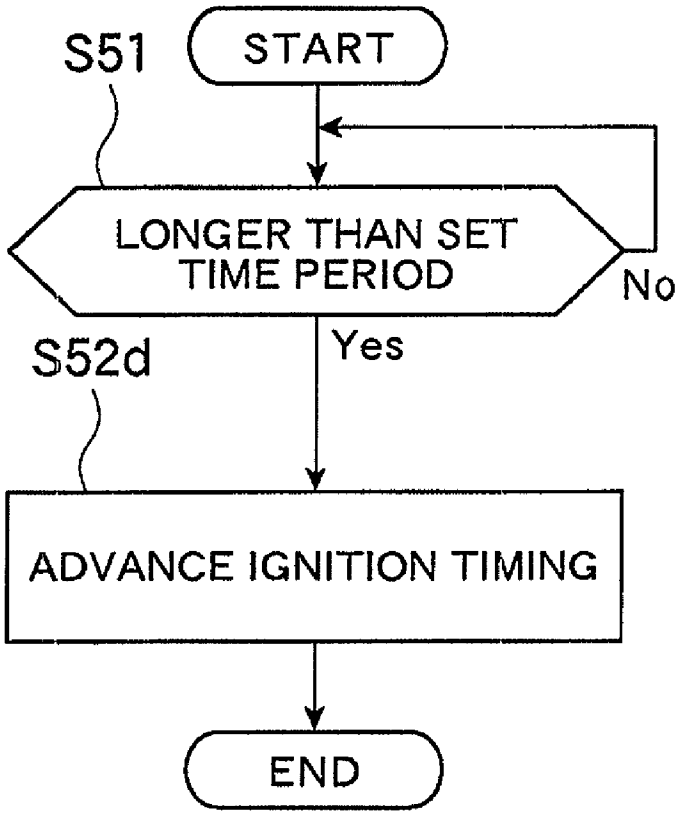
FIG. 13B is a flow chart showing a control for restoring the output power of the engine.
Figure 13A:
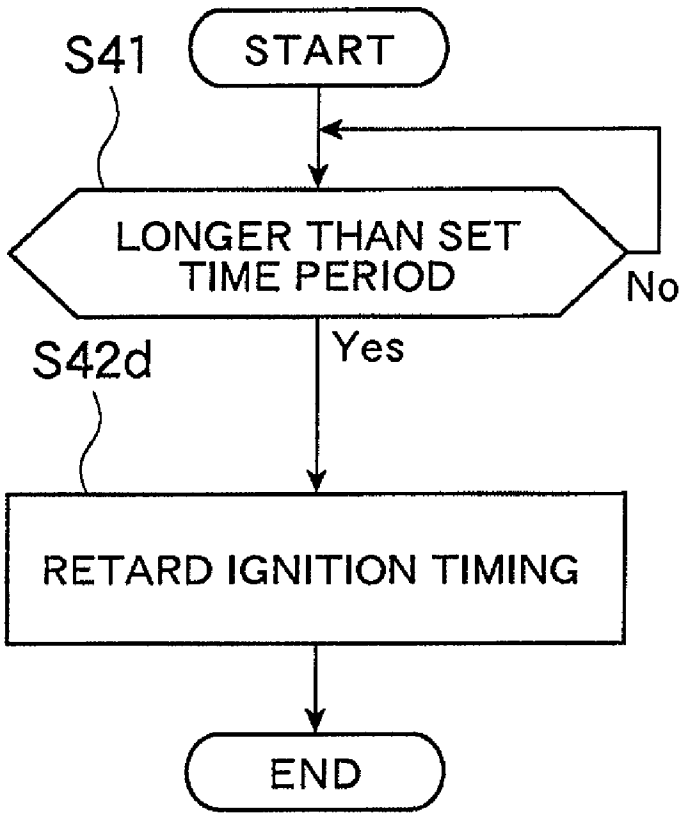
FIG. 13A is a flow chart showing an output power control of the engine of the speed control system of the small planing boat of FIG. 12 when the vessel speed of the small planing boat exceeds a maximum speed limit.

FIGS. 12, 13A and 13B show additional embodiments. As shown in the functional block diagram in FIG. 12, in the vessel speed control system 10E of the small planing boat of this embodiment, an ignition timing control unit 103, which can serve as "ignition timing control means" can be provided in the ECU 60 instead of the ignition frequency control unit 102. The ignition timing control unit 103 controls the ignition timing of the engine 19 based on the output power value of the engine 19 acquired by the output power acquiring unit 101.

According to this configuration, the "ignition state control means" of this embodiment comprises the output power acquiring unit 101 and the ignition timing control unit 103. Other configurations are the same as that in the fourth embodiment.

The operational procedures of such embodiments can be basically the same or similar to that of some of the above embodiments. As shown in the flowchart in FIG. 13A, in an output power control (Step S4), after the procedure of step S41, the "ignition state control means" of the ECU 60 performs a control to retard the ignition timing of the engine 19 (Step S42*d*). For example, the "output power control means" and the "ignition state control means" of the ECU 60 perform controls of $a_3$ to $d_3$ procedures described below.

$a_3$: The revolution speed acquiring unit 63 acquires a surplus revolution speed value like the above $a_2$ procedure.

$b_3$: The output power acquiring unit 101 acquires a surplus output power value of the engine 19 like the above $b_2$ procedure.

$c_3$: The ignition timing control unit 103 performs a setting to retard the ignition timing of the engine 19, based on the acquired surplus output power value of the engine 19. The setting is performed in terms of time period but may be performed in terms of degree (or angle) of retardation of the ignition timing. When the setting is performed in terms of time period, the more the surplus output power is, the longer the setting time period is set. When the setting is performed in terms of the amount of retardation, the more the surplus output power is, the more the amount of retardation is set.

$d_3$: The ignition timing control unit 103 retards the ignition timing by retarding the conduction timing to the ignition coil 43 for a set time period. However, when the retardation amount is set at the $c_3$ procedure, the ignition timing control unit 103 retards the ignition timing by conducting electricity to the ignition coil 43 at a set ignition timing.

After the completion of $a_3$ to $d_3$ procedures, the output power control (Step S4) is completed.

While, as shown in the flowchart in FIG. 13B, after the procedure of Step S51, in the control (Step S5) to restore the output power of the embodiment, the "ignition state control means" of the ECU 60 performs the control to advance the ignition timing of the engine 19 (Step S52*d*) instead of Step S52*c*. For example, the "output power control means" and the "ignition state control means" of ECU 60 perform the following $e_3$ to $h_3$ procedures.

$e_3$: The revolution speed acquiring unit 63 acquires a surplus revolution speed value like the above $e_2$ procedure.

$f_3$: The output power acquiring unit 101 acquires an insufficient output power value of the engine 19 like the above $f_2$ procedure.

$g_3$: The ignition timing control unit 103 performs setting to advance the ignition timing of the engine 19 based on the acquired insufficient output power value of the engine 19. Setting is performed in terms of time period during which the ignition timing is advanced, but may be performed in terms of advancement of the degree or angle of the ignition timing. When the setting is performed in terms of time period, the more the insufficient output power value is, the longer the time period is set. When the setting is performed in terms of the advancing degree, the more the insufficient output power value is, the more the amount of the advancing degree is set.

$h_3$: The ignition timing control unit 103 advances ignition timing by advancing the conduction timing to the ignition coil 43 from the normal conduction timing for a set time. When the advancing amount is set in $c_3$, the ignition timing control unit 103 advances the ignition timing by applying current to the ignition coil 43 at the set ignition timing.

After the completion of $e_3$ to $h_3$ procedures, the control to restore the output power is completed (Step S5).

As mentioned above, in some embodiments, the "ignition state control means" can comprise the output power acquiring unit 101 for acquiring, by calculation etc. based on the correlation between the vessel speed and the maximum vessel speed limit, a surplus output power value in the output power of the engine 19 over the output power of the engine 19 necessary to make the vessel speed of the small planing boat 10 reach a predetermined speed, and the ignition timing control unit 103 for retarding the ignition timing of the engine 19 based on the acquired surplus output power value. Therefore, by adopting a simple configuration to control the ignition state in the combustion chamber 58 of the engine 19 and by simply controlling the ignition timing, the speed control to keep the boat speed below the set maximum vessel speed can be realized more accurately.

Figure 14:
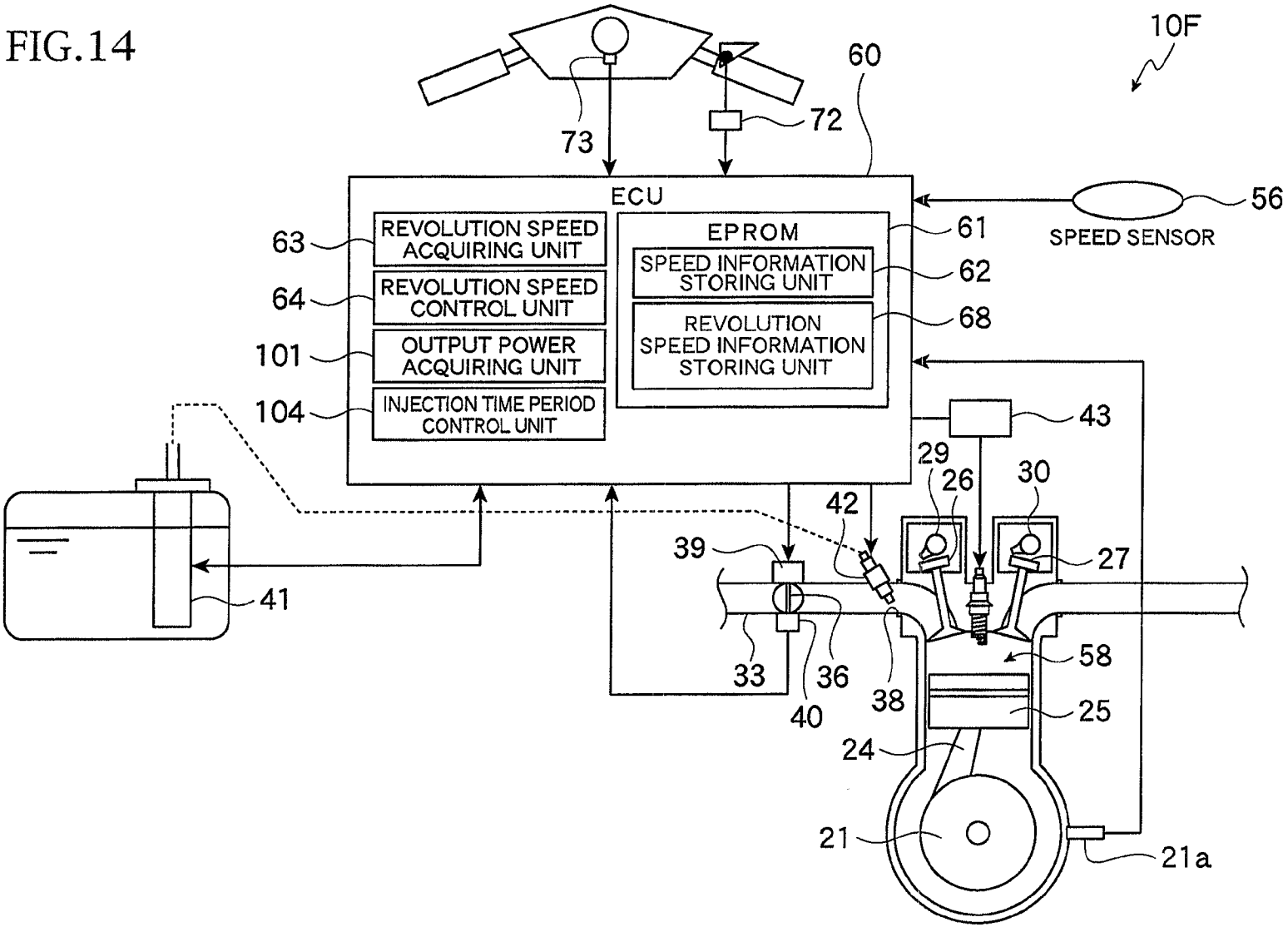
FIG. 14 is a functional block diagram of a speed control system of a small planing boat according to a sixth embodiment.
Figure 15A:
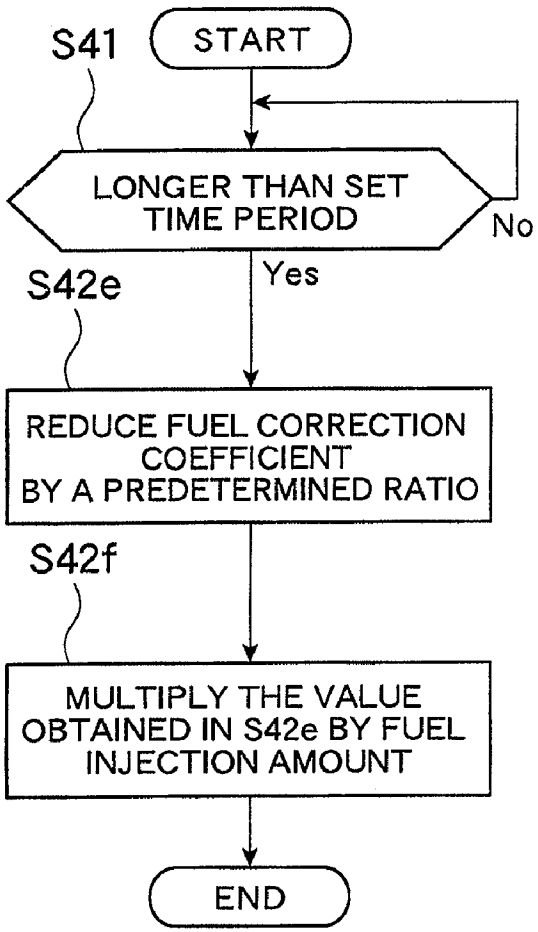
FIG. 15A is a flow chart showing an output power control of the engine of the speed control system of the small planing boat of FIG. 14 when the vessel speed of the small planing boat exceeds a maximum speed limit.
Figure 15B:
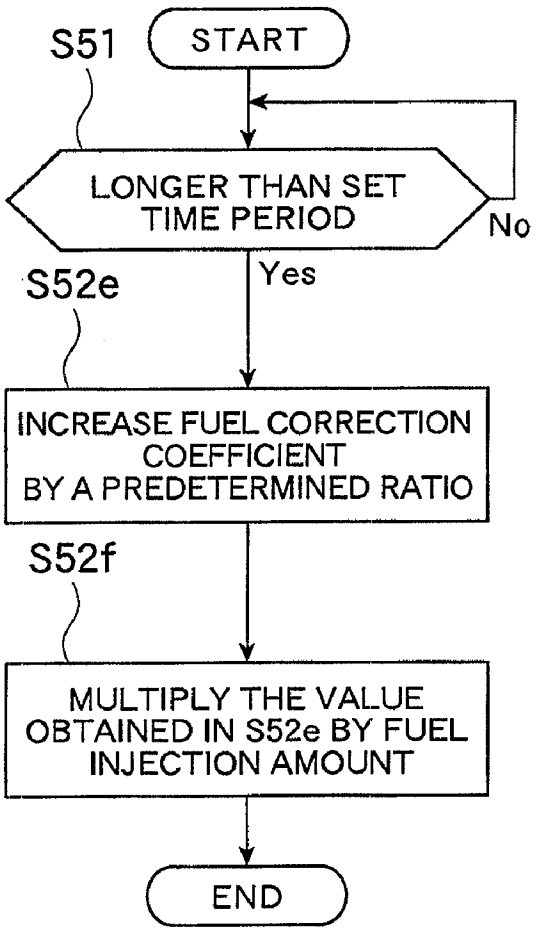
FIG. 15B is a flow chart showing a control for restoring the output power of the engine.

FIGS. 14, 15A and 15B show additional embodiments. As shown in the functional block diagram in FIG. 14, in a speed control system 10F of the small planing boat of some embodiments, an injection time period control unit 104, which can serve as "injection time period control means" can be provided to the ECU 60 instead of the ignition frequency control unit 102. The injection time period control unit 104 controls an injection time period of fuel injecting from an injector 42 into the combustion chamber 58 of the engine 19 based on the acquired surplus output power value of the engine 19 acquired at the output power acquiring unit 101.

According to the above mentioned configuration, the small planing boat 10 of some embodiments can be provided with "fuel feeding state control means" as the "output power control means" for decreasing the fuel feeding amount into the combustion chamber 58 of the engine 19. This "fuel feeding state control means" comprises the output power acquiring unit 101 and the injection time period control unit 104. Other configurations are the same as in the fourth embodiment.

The operational procedure of such embodiments can be basically the same or similar as that of some of the above embodiments. As shown in the flowchart in FIG. 15A, in an output power control step (Step S4), the "fuel feeding state control means" performs a control to reduce the injection time period of fuel injecting from the injector 42 instead of the step of S42*c* after the Step of S41. That is, the injection time period control unit 104 calculates a fuel injection time period by at first obtaining a value by subtracting a predetermined ratio of a previously set fuel correction coefficient from the predetermined ratio (Step 42*e*) and then multiplying the value obtained by the above-mentioned subtraction by the fuel feeding amount from the injector 42 (Step S42*f*). In addition, prior to the procedure of Step S42*e*, the "output power control means" and the "fuel feeding state control means" of the ECU 60 perform the following a4 and $b_4$ procedures and the injection time period control unit 104 calculates the predetermined ratio based on the acquired output power value of the engine 19 acquired at the procedure of $b_4$.

$a_4$: The revolution speed acquiring unit 63 acquires a surplus revolution speed value like the above mentioned procedure of $a_2$.

$b_4$: The output power acquiring unit 101 acquires a surplus output power value of the engine 19 like the above mentioned procedure of $b_2$.

Meanwhile, as shown in the flowchart in FIG. 15B, in the control of this embodiment in which the output power is restored (Step S5), the injection time period control unit 104 performs, instead of Step S52*c*, a control to increase the injection time period of fuel injecting from the injector 42 after the procedure of Step S51. For example, the injection time period control unit 104 calculates a fuel injection time period by at first obtaining a value by adding the previously set fuel correction coefficient to the predetermined ratio of the previously set fuel correction coefficient (Step S52*e*) and then multiplying the value obtained by the above-mentioned addition by the fuel feeding amount from the injector 42 (Step S52*f*). In addition, prior to the procedure of Step S52*e*, the "output power control means" and the "fuel feeding state control means" of the ECU 60 perform a control of $e_4$ and $f_4$ described below. The injection time period control unit 104 calculates the predetermined ratio based on the acquired output power value of the engine 19 acquired at the procedure of $b_4$.

$e_4$: The revolution speed acquiring unit 63 acquires an insufficient revolution speed value like the above mentioned procedure of $e_2$.

$f_4$: The output power acquiring unit 101 acquires an insufficient output power value of engine 19 like the above mentioned procedure of $f_2$.

As mentioned above, the "output power control means" In some embodiments is the "fuel feeding state control means" for decreasing the fuel feeding amount supplied into the combustion chamber 58 of the engine 19, so that the maximum speed of the small planing boat 10 can be smoothly kept below a certain speed by using a simple system for controlling the feeding state of fuel into the combustion chamber 58. In addition, many conventional systems for performing the fuel feeding state control for engine 19 can be used together with this configuration so that simple configuration and low production cost can be realized.

In some embodiments, the "fuel feeding state control means" comprises the output power acquiring unit 101 which acquires, by calculation etc. based on a result of the correlation between the vessel speed and the maximum vessel speed limit, a surplus output power value in a current output power of the engine 19 over the output power of the engine 19 necessary to make the vessel speed of the small planing boat 10 reach a predetermined vessel speed; and the injection time period control unit 104 for decreasing the fuel injection time period with respect to the combustion chamber 58 of the engine 19 based on the acquired surplus output power value. Accordingly, by adopting a simple configuration to control the feeding state of fuel into the combustion chamber 58, and by simply controlling the injection time period of fuel into the combustion chamber 58, the speed control to keep the vessel speed below the set maximum speed can be accurately realized.

Figure 16:
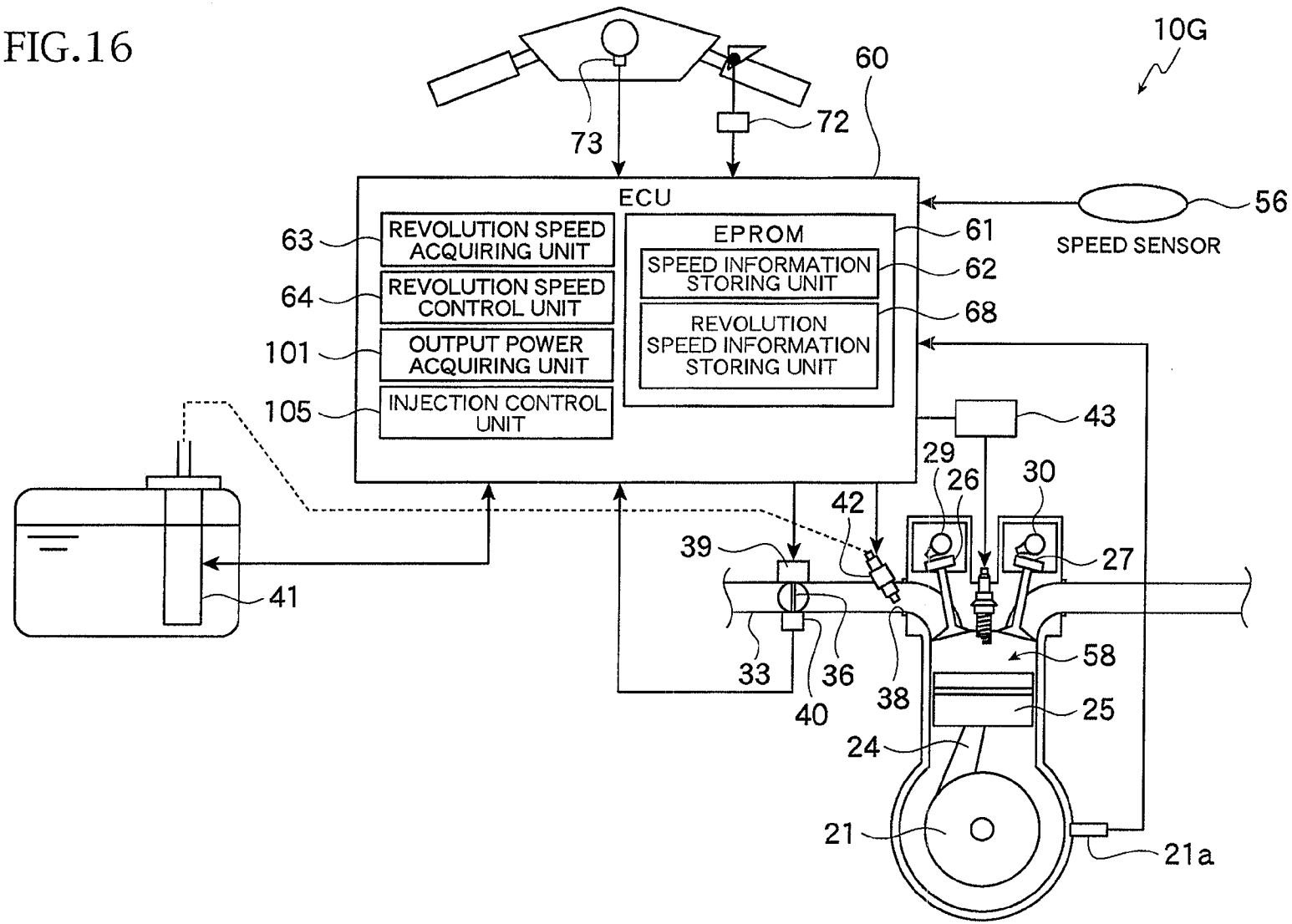
FIG. 16 is a functional block diagram of a speed control system of a small planing boat according to a seventh embodiment.
Figure 17A:
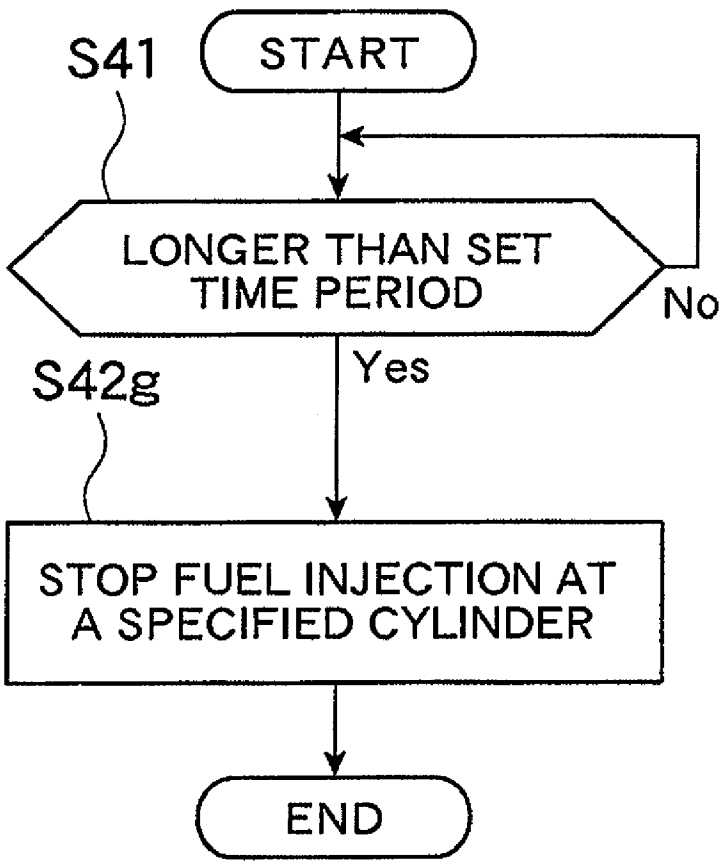
FIG. 17A is a flow chart showing an output power control of the engine of the speed control system of the small planing boat of a FIG. 16 when the vessel speed of the small planing boat exceeds a maximum speed limit.
Figure 17B:
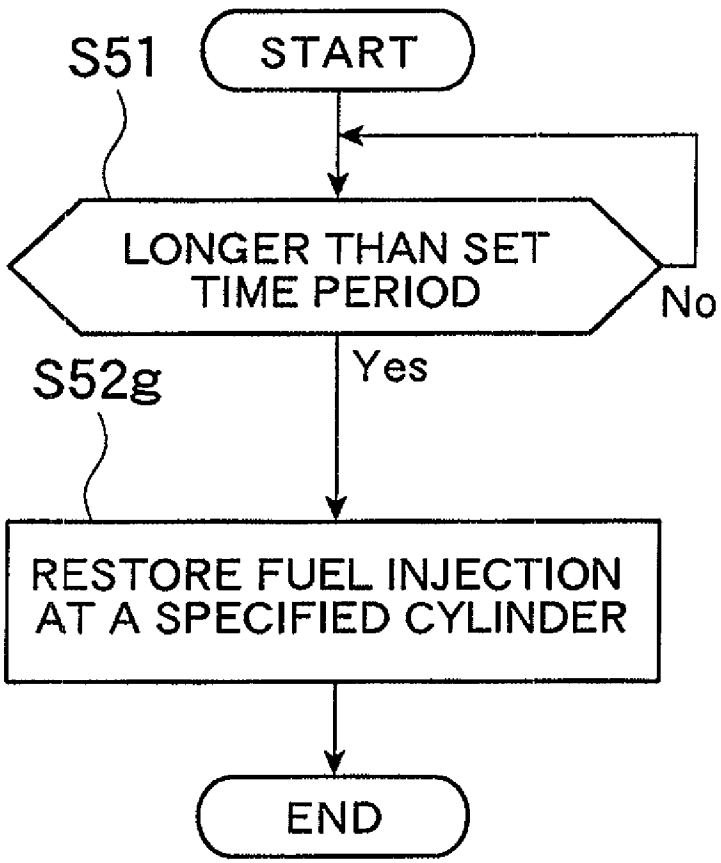
FIG. 17B is a flow chart showing a control for restring the output power of the engine.

FIGS. 16, 17A and 17B show additional embodiments. As shown in the functional block diagram in FIG. 16, in the speed control system 10G of the small planing boat of this embodiment, the ECU 60 can have an injection control unit 105 as "injection stopping means" instead of the ignition frequency control unit 102. This injection control unit 105 performs the stopping or starting of the fuel injection from the injector 42 into the combustion chamber 58 of the engine 19 based on the acquired output power value of the engine 19 acquired by the output power acquiring unit 101.

According to the configuration mentioned above, the "fuel feeding state control means" of the small planing boat 10 of this embodiment comprises the output power acquiring unit 101 and the injection control unit 105. Other configurations are the same as that of the fourth embodiment.

The operational procedures of such embodiments can be basically the same or similar as that of some of the above embodiments. As shown in the flowchart in FIG. 17A, in the output power control (Step S4), after the completion of Step S41, instead of Step S42*c*, the "fuel feeding state control means" of the ECU 60 performs a control to stop the injection of fuel from the injector 42 (Step S42*g*). For example, the "output power control means" and the "fuel feeding state control means" of the ECU 60 perform the control of a5 to d5 procedures described below.

$a_5$: The revolution speed acquiring unit 63 acquires the surplus revolution speed value like the above procedure of $a_2$.

$b_5$: The output power acquiring unit 101 acquires the surplus output power value of the engine 19 like the above procedure of $b_2$.

$c_5$: The injection control unit 105 performs a setting to stop the injection of fuel from the injector 42 at the specified cylinder 20 based on the acquired surplus output power value of the engine 19. The setting is made such that the higher the surplus output power value is, the larger the number of cylinder 20 at which the injection is stopped is set, but the setting may also be made in such a manner that the higher the surplus output power value is, the longer the time period for stopping the injection of the fuel of the specified cylinder 20, for example only the cylinder 201, may be set.

$d_5$: The injection control unit 105 stops the injection of fuel from the injector 42 at a set cylinder 20 for a certain time period. When time period is set in the procedure of $c_5$, the injection control unit 105 stops the injection of fuel from the injector 42 at a specified cylinder (for example, the cylinder 201) for a set time period.

After the completion of the procedures of $a_5$ to $d_5$, the output power control (Step S4) is completed.

On the other hand, as shown in the flowchart in FIG. 17B, in the control (Step S5) to restore the output power of this embodiment, after the Step S51, instead of Step S52*c*, the "fuel feeding state control means" of the ECU 60 performs a control to start the injection of fuel from the injector 42 (Step S52*g*). For example, the "output power control means" and the "fuel feeding state control means" of the ECU 60 perform the control of the procedures of $e_5$ to $h_5$ below.

$e_5$: The revolution speed acquiring unit 63 acquires a surplus revolution speed value like in the procedure of e2.

$f_5$: The output power acquiring unit 101 acquires an insufficient output power value of the engine 19 like in the procedure of $f_2$.

$g_5$: The injection control unit 105 performs a setting to perform the injection of fuel from the injector 42, at the specified cylinder 20. The setting is performed such that the higher the insufficient output power value is, the larger the number of cylinders 20 which is used for injecting the fuel is set, but the setting may also be performed such that the higher the insufficient output power is, the longer the time period for performing the fuel injection at a specified cylinder such as only the cylinder 201 is set.

$h_5$: The injection control unit 105 performs the injection of fuel from the injector 42 at a set cylinder 20 for a certain time period. When the stopping time period is set at the procedure of $g_5$, the injection control unit 105 performs the injection of fuel from the injector 42, at a specified cylinder (for example, the cylinder 201) for a set time period.

After the completion of the procedures of $e_5$ to $h_5$, the control for restoring the output power (Step S5) is completed.

As mentioned above, in some embodiments, the "fuel feeding state control means" can comprise the output power acquiring unit 101 for acquiring, by calculation etc. based on a result of the correlation between vessel speed and the maximum speed limit, a surplus output power value in a current output power of the engine 19 over the output power of the engine 19 necessary to make the vessel speed of the small planing boat 10 reach a predetermined speed; and the injection control unit 105 for stopping the injection of fuel into the combustion chamber 58 of the engine 19 for a predetermined time period, based on the acquired surplus output power value. Accordingly, by adopting a simple configuration to control the feeding state of the fuel into the combustion chamber 58 of the engine 19, the injection of the fuel into the combustion chamber 58 of the engine 19 is simply stopped for a predetermined time period and the speed control to keep the vessel speed below the set maximum speed can be accurately realized.

FIGS. 18A to 20*c* show additional embodiments. As shown in the schematic diagram in FIG. 18A, in a small planing boat 10 of some embodiments, "jet pressure control means" is provided for decreasing or increasing the thrust force by controlling a jet pressure of water jetted from a nozzle 111 as shown on the right side of A-A' line in FIG. 18A. The "jet pressure control means" can have following configuration.

Figures 18A, 18B, 18C, 18D:
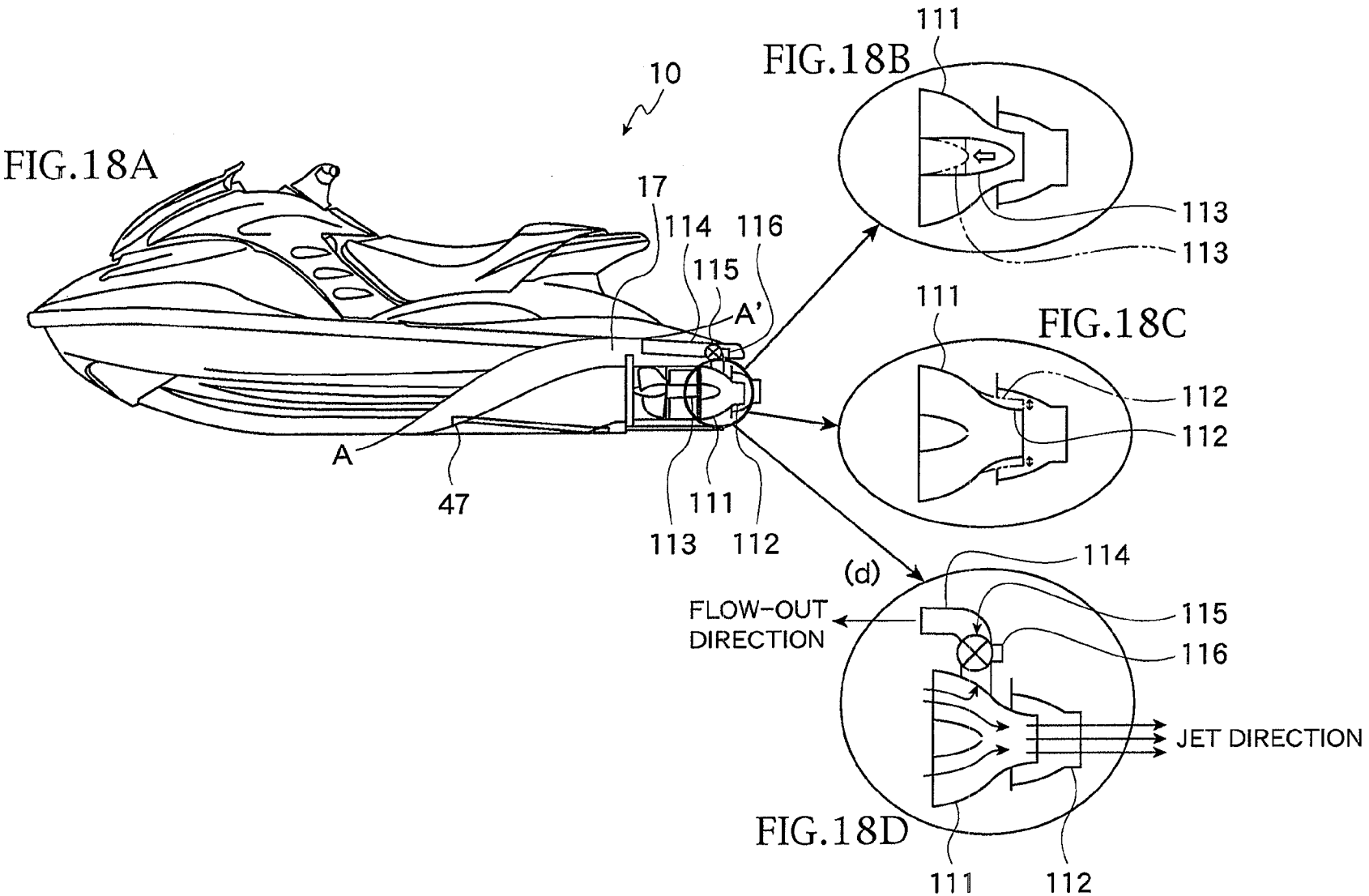
FIG. 18A is a schematic diagram showing a small planing boat of an eighth embodiment, a portion of which is cutaway along the line of A-A'.
FIG. 18B is a schematic diagram showing a nozzle cone of the small planing boat of FIG. 18A.
FIG. 18C is a schematic diagram showing a front end portion of the nozzle of the small planing boat of FIG. 18A.
FIG. 18D is an enlarged view of a bypass tube of the small planing boat of FIG. 18A.

As shown in FIG. 18C, a front end portion 112 of the nozzle 111 provided to the boat body 11 of the small planing boat 10 can be formed roughly in a funnel shape as a whole by disposing a plurality of plates such that adjacent plates are overlapped with each other. The front end portion can be made smaller or larger in diameter by an operation of an actuator (not shown).

On the other hand, as shown in FIG. 18B, near the front end portion 112 in an inner side of the nozzle 111, a bombshell type nozzle cone 113, an end of which is made small in diameter, is provided. This nozzle cone 113 is provided to be movable back and forth in a shaft direction by a move of an actuator (not shown).

Further, as shown in FIG. 18D, from a portion of the nozzle 111, a bypass tube 114 is branched. One end of the bypass tube 114 can be opened to an inside of a pump chamber 17 so that a portion of water flowing through the nozzle 111 flows toward an inside of the pump chamber 17, or toward a direction other than a direction directed toward the front end portion 112 of the nozzle 111.

The bypass tube 114 can be provided with a bypass valve 115. The bypass valve 115 can be provided with a solenoid 116 as an "actuator" which controls an opening degree of the bypass valve 115 to control a flow amount of water passing through the bypass tube 114, according to an electric current applied on the solenoid 116.

Figure 19:
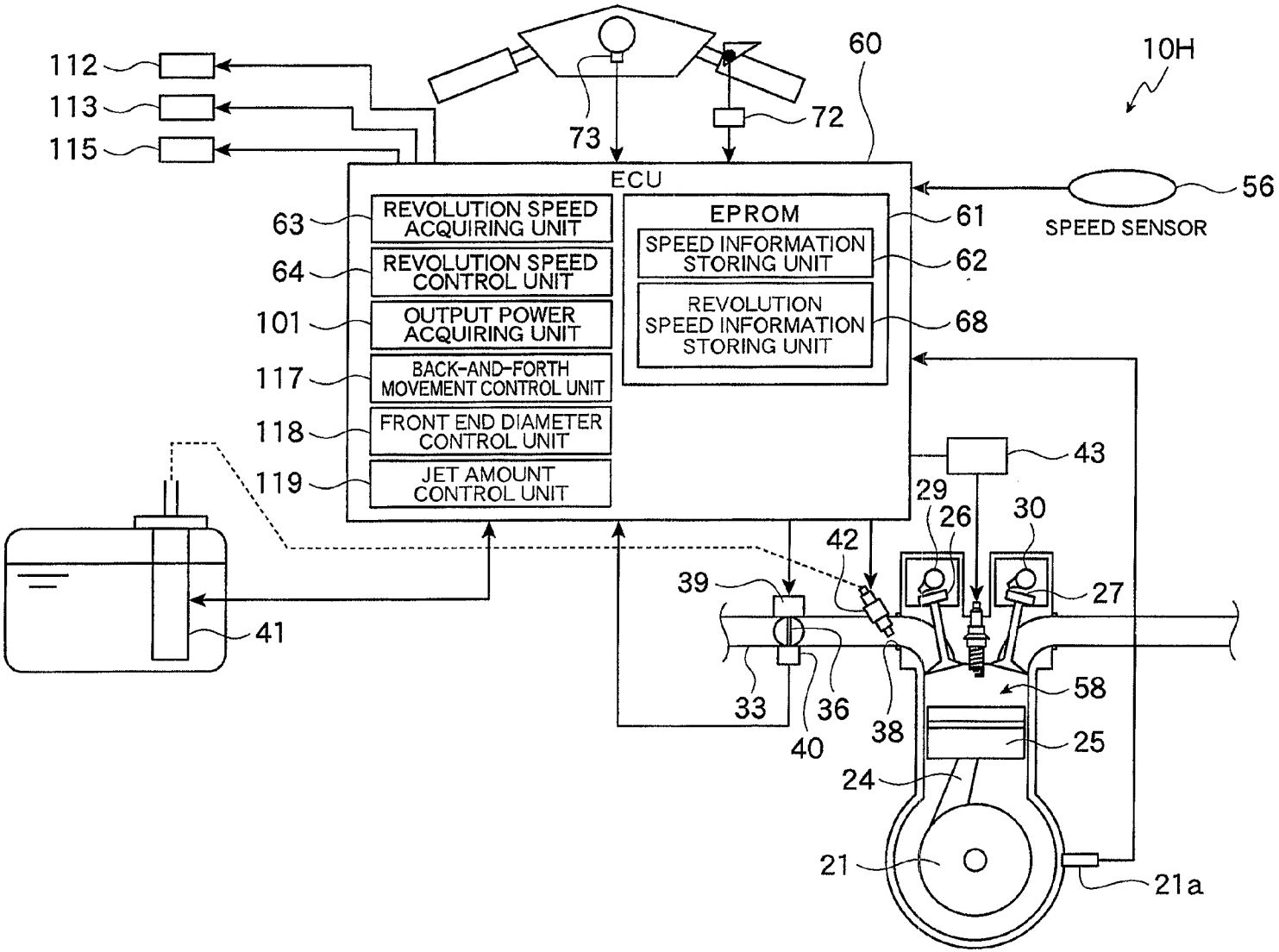
FIG. 19 is a functional block diagram of a speed control system of the small planing boat of FIG. 18A.

As shown in the functional block diagram in FIG. 19, in a speed control system 10H of the small planing boat of some embodiments, the ECU 60 can have a back and forth movement control unit 117 as "back and forth movable control means" instead of the ignition frequency control unit 102, a front end diameter control unit 118 as "front end diameter control means" and a jet amount control unit 119 as "jet amount control means." The back and forth movement control unit 117 controls a pipe diameter of the nozzle 111 by moving the nozzle cone 113 back and forth based on the acquired output power value of the engine 19 acquired at the output power acquiring unit 101. The front end diameter control unit 118 increases or decreases the diameter of the front end portion 112 of the nozzle 111 based on the acquired output power value of the engine 19 acquired at the output power acquiring unit 101. The jet amount control unit 119 increases or decreases the opening degree of the bypass valve 115 based on the acquired output power value of the engine 19 acquired at the output power acquiring unit 101. Other configurations can be the same or similar as that of the first embodiment.

Figure 20A:
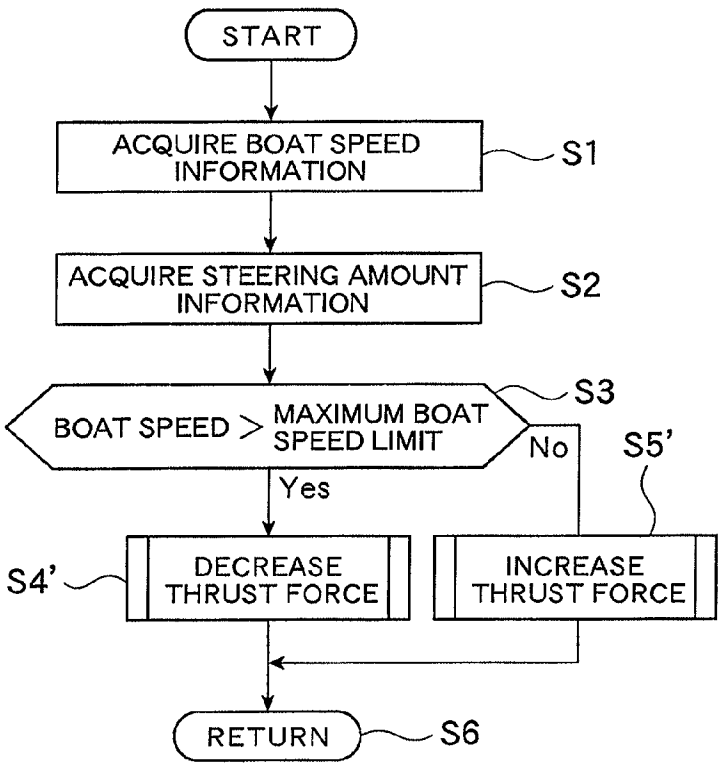
FIG. 20A is a flow chart showing a general procedure of a speed control using the speed control system of the small planing boat of FIG. 19.
Figure 20B:
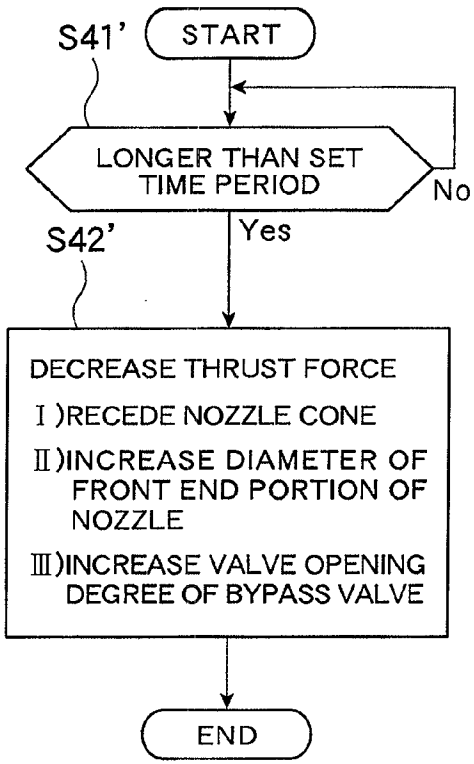
FIG. 20B is a flow chart showing a control to reduce a thrust force.
Figure 20C:
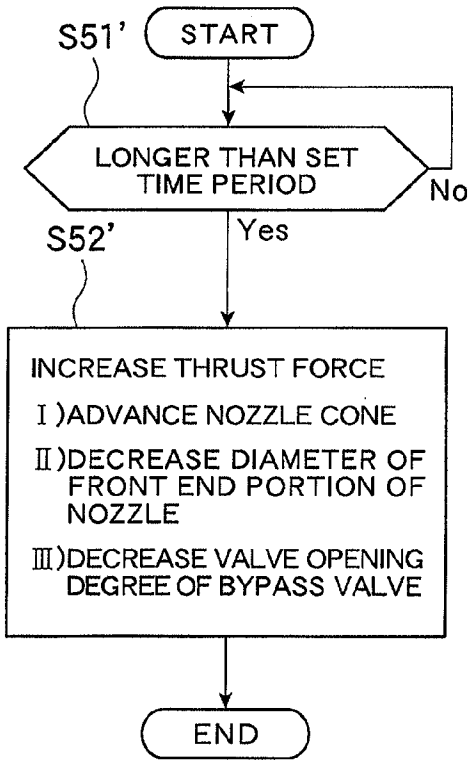
FIG. 20C is a flow chart showing a control to increase the thrust force.

Operational procedures of such embodiments are shown in FIG. 20A. Steps S1 to S3 can be the same or similar as that of the first embodiment. Instead of the output power control (Step S4) as shown in the flowchart in FIG. 20A, a thrust-force-decreasing control (Step S4') is performed. For example, after the completion of Step S41' (same as Step S41) as shown in FIG. 20B, "jet pressure control means" performs a control to decrease the thrust force by controlling a jet pressure of water jetted from the nozzle 111 (Step S42'). The decrease in the thrust force is made by at least one of I) to III) described below.

I) Increase in the pipe diameter of the nozzle 111 by moving the nozzle cone 113 backward, II) Increase in the diameter of the front end portion 112 of the nozzle 111, and III) Increase in the opening degree of the bypass valve 115

For example, the "output power control means" and the "jet pressure control means" of the ECU 60 perform a control of the following procedures of $a_6$ to $d_6$.

$a_6$: The revolution speed acquiring unit 63 acquires a surplus revolution speed value like the above procedure of $a_1$.

$b_6$: The output power acquiring unit 101 acquires a surplus output power value of the engine 19 like the above procedure of $b_1$.

$c_6$: The back-and-forth movement control unit 117, the front end diameter control unit 118 and the jet amount control unit 119 perform a setting to decrease the thrust force based on the surplus output power value of the engine 19. That is, the back-and-forth movement control unit 117 performs a setting to recede the nozzle cone 113; the front end diameter control unit 118 performs a setting to increase the diameter of the front end portion 112; and the jet amount control unit 119 performs a setting to increase the opening degree of the bypass valve 115. The setting is performed such that the larger the surplus output power value is, the more the amount of recession of the nozzle cone 113, the more the amount of the diameter of the front end portion 112 and the more the amount of the opening degree of the bypass valve 115 are set respectively. However, the setting may be performed such that the larger the surplus output power value is, the longer the time period of the recession of the nozzle cone 113, the longer the time period during which the diameter of the front end portion 112 is enlarged and the longer the time period during which the opening degree of the bypass valve 115 is increased, is set respectively.

$d_6$: The back-and-forth movement control unit 117, the front end diameter control unit 118 and the jet amount control unit 119 are designed to retreat the nozzle cone 113, to increase the diameter of the front end portion 112 of the nozzle 111 and to increase the opening degree of the bypass valve 115 by the set amount for a predetermined time period, respectively. In addition, in the procedure of $c_6$, when the stopping time period is set, the back-and-forth movement control unit 117, the front end diameter control unit 118 and the jet amount control unit 119 make the nozzle cone 113, the front end portion 112 of the nozzle 111 and the opening degree of the bypass valve 115 recede or increase by a certain amount for a set time period, respectively.

After the completion of the above procedures of $a_6$ to $d_6$, the control to decrease the thrust force (Step S4') is completed.

On the other hand, as shown in FIG. 20A, in some embodiments, the control to increase the thrust force is performed (Step S5') instead of the control to restore the output power in the first embodiment (Step S5). For example, after Step S51' (same as Step S51), the "jet pressure control means" controls a jet pressure of water jetted from the nozzle 111 to perform a control to increase the thrust force (Step S52'). The thrust forth is increased by at least one of the following procedures of I) to III).

I) Decrease in the pipe diameter of the nozzle 111 by forwarding the nozzle cone 113.

II) Decrease in the diameter of the front end portion 112 of the nozzle 111, and III) Decrease in the opening degree of the bypass valve 115.

For example, the "output power control means" and the "jet pressure control means" of the ECU 60 perform a control of the following procedures of $e_6$ to $h_6$.

$e_6$: The revolution speed acquiring unit 63 acquires an insufficient revolution speed value like the procedure of e1 mentioned above.

$f_6$: The output power acquiring unit 101 acquires a surplus output power value of the engine 19 like the procedure of $f_1$ mentioned above.

$g_6$: The back-and-forth movement control unit 117, the front end diameter control unit 118 and jet amount control unit 119 perform a setting to increase the thrust force based on the acquired insufficient output power of the engine 19. That is, the back-and-forth movement control unit 117 performs a setting to forward the nozzle cone 113; the front end diameter control unit 118 performs a setting to decrease the front end portion 112 of the nozzle 111; and the jet amount control unit 119 performs a setting to decrease the opening degree of the bypass valve 115, respectively.

The setting can be carried out such that the larger the shortage of the output power is, the more the forward amount of the nozzle cone 113 is set; the more the increase in the diameter of the front end portion 112 is set; and the more the decrease in the opening degree of the bypass valve 115 is set, respectively. However, the setting can also be carried out such that the larger the shortage of the output power value is, the longer the time period during which the nozzle cone 113 is forwarded, the longer the time period during which the front end portion 112 is decreased and the longer the time period during which the opening degree of the bypass valve 115 is decreased, are set, respectively.

$h_6$: The back-and-forth movement control unit 117 makes the nozzle cone 113 forward; the front end diameter control unit 118 makes the front end portion 112 of the nozzle 111 decrease in diameter; and the jet amount control unit 119 makes the opening degree of the bypass valve 115 decrease; by a set amount for a certain period, respectively. However, when the stopping time period is set in $g_6$, the back-and-forth control unit 117 makes the nozzle cone 113 forward; the front end diameter control unit 118 makes the front end portion 112 of the nozzle 111 decrease in diameter; and the jet amount control unit 119 make the opening degree of the bypass valve 115 decrease; by a certain amount for a set time period, respectively.

After the completion of the procedures of $e_6$ to $h_6$, the control to restore the output power (Step S5) is completed.

As mentioned above, in some embodiments, the "speed control means" can comprise the "jet pressure control means" for decreasing the thrust force by controlling the jet pressure of water from the nozzle 111. Accordingly, a driving speed can be surely changed and controlled by changing the jet pressure of the water, which is the source of the thrust force, and the cruising speed of the small planing boat 10 can be surely kept below the set maximum speed limit without affecting the driving state of the engine 19.

In some embodiments, the "jet pressure control means" can comprise the nozzle cone 113 which is provided near the front end portion 112 of the inner side of the nozzle 111 and is movable in the shaft direction of the nozzle 111 by the operation of an actuator (not shown) so as to control the pipe diameter of the nozzle 111; the output power acquiring unit 101 for acquiring, by calculation etc. based on a result of a correlation between the vessel speed and the maximum speed limit, a surplus output power value in the current output power of the engine 19 over the output power of the engine 19 necessary to make the vessel speed of the small planing boat reach the predetermined speed; and the back-and-force movement control unit 117 which decreases the thrust force generated by the jet spray by controlling the back-and-forth movement of the nozzle cone 113 based on the acquired surplus output power value. Accordingly, the pipe diameter of the nozzle 111 is controlled and the jet pressure can thereby be controlled by controlling the back-and-forth movement of the nozzle cone 113 based on the acquired surplus output power value. Thereby, the speed control to keep the cruising speed of the small planing boat 10 below the set maximum speed limit can be surely carried out.

In some embodiments, the "jet pressure control means" can comprise the output power acquiring unit 101, which is designed to increase or decrease the diameter of the front end portion 112 of the nozzle 111 by the operation of an actuator (not shown) and to acquire, by calculation etc. based on a result of correlation between a vessel speed and the maximum speed limit, a surplus output power value of the engine 19 in the current output power of the engine 19 over the output power of the engine 19 necessary to make the speed of the small planing boat 10 reach a predetermined vessel speed; and the front end diameter control unit 118 to decrease the thrust force generated by the jet spray by increasing the diameter of the front end portion 112 of the nozzle 111 based on the acquired surplus output power value. By increasing the front end portion 112 of the nozzle 111, the pipe diameter of the nozzle 111 and the jet pressure can be controlled. Accordingly, the vessel speed of the small planing boat 10 can be surely kept below the set maximum vessel speed limit.

In some embodiments, the "jet pressure control means" can comprise a bypass tube 114 which is branched from the nozzle 111 so as to make a portion of water passing through the nozzle 111 flow in a direction other than a direction directed by the front end portion 112 of the nozzle 111, the bypass valve 115 driven by the actuator (not shown) for controlling a flow rate of water passing through the bypass tube 114; the output power acquiring unit 101 for acquiring, by calculation etc. based on a result of the correlation between the vessel speed and the maximum speed limit, a surplus output power value in the current output power of the engine 19 over the output power of the engine 19 necessary to make the speed of the small planing boat 10 reach the predetermined speed; and the jet amount control unit 119 which decrease the thrust force generated by the jet spray by increasing the opening degree of the bypass valve 115 based on the acquired surplus output power value. By opening the bypass valve 115, a portion of water passing through the nozzle 111 can be flowed through the bypass tube 114 to decrease the jet pressure from the nozzle 111 so that the speed of the small planing boat 10 can be surely kept within the set maximum speed limit.

In addition, in some embodiments, all of the back-and-forth movement of the nozzle cone 113, the diameter of the front end portion 112 of the nozzle 111, and the opening degree of the bypass valve 115 of the bypass tube 114 are all made to be controllable. However, in some embodiments, only one or two selected from the group consisting of the back-and-forth movement of the nozzle cone 113, the diameter of the front end portion 112 of the nozzle 111, and the opening degree of the bypass valve 115 can be used to control the vessel speed. Alternatively, either one or two selected from the group consisting of the back-and-forth movable nozzle cone 113, the front end portion 112 having the increasable and decreasable diameter, the bypass tube 114 and the bypass valve 115 controllable in the opening degree can be mounted on the boat for this purpose.

FIGS. 21 to 23C show additional embodiments. As shown in the schematic diagram in FIG. 21, in the small planing boat 10 of some embodiments, there can be provided "resistance control means" for increasing or decreasing the boat body's resistance to the fluid by changing a contact area of the boat body with the water. This "resistance control means" can have the structure noted below, as well as other structures.

Figure 21:
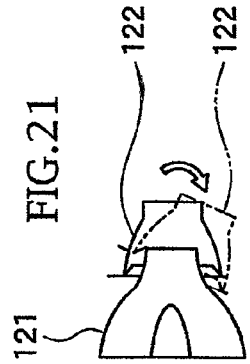
FIG. 21 is an enlarged view showing a nozzle and a nozzle deflector of a small watercraft.

A nozzle deflector 122 as a front end portion of the nozzle 121 is provided to the boat body 11 of the small planing boat 10. This nozzle deflector 122, as shown in FIG. 21, changes the jet direction of the water by moving the deflector's attitude toward a vertical or a horizontal direction by the operation of an actuator (not shown). As used herein, the term "inclined angle" is a reference to an inclined angle with respect to the horizontal direction (hereinafter simply referred to as "inclined angle").

Figure 22:
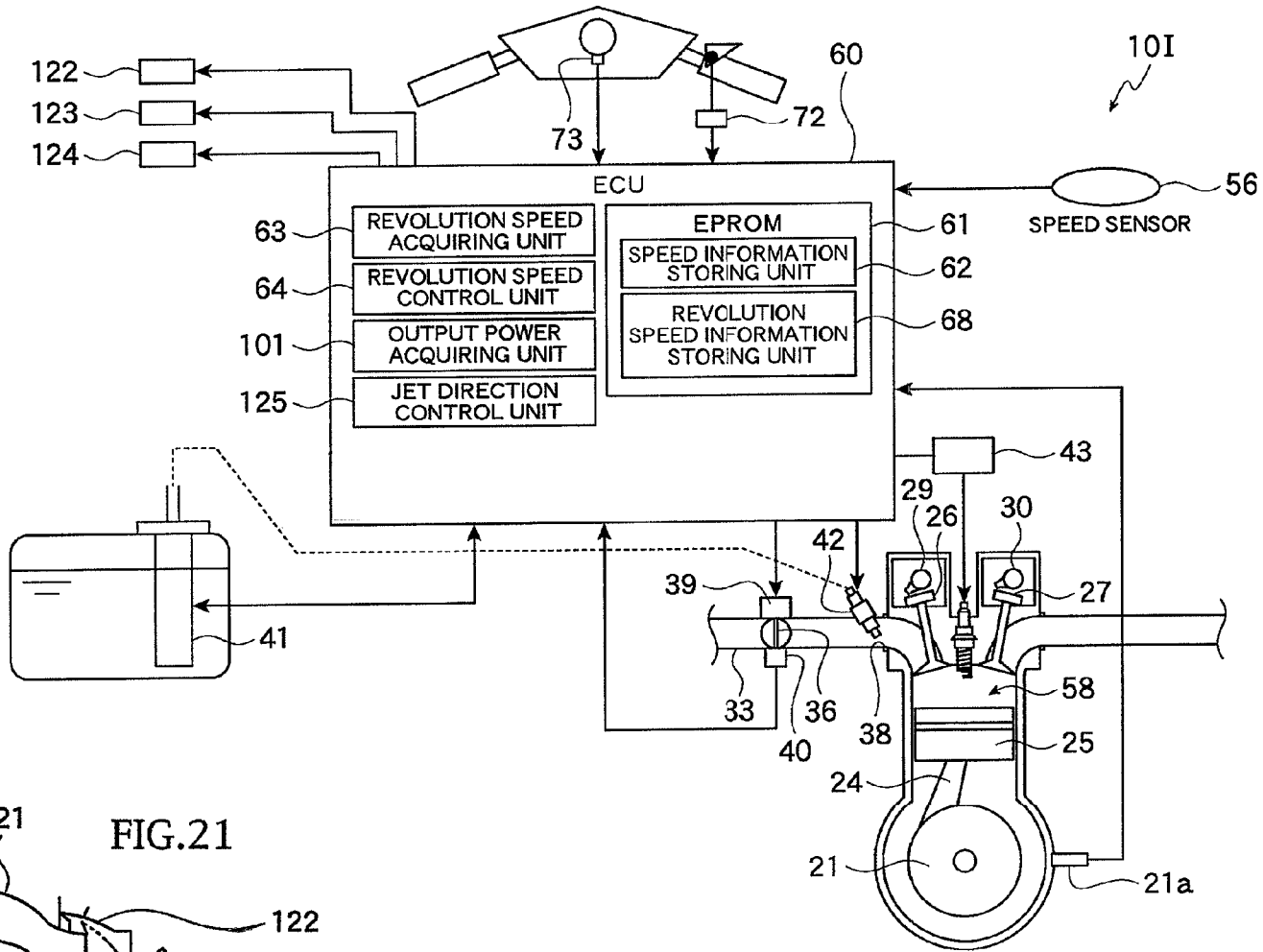
FIG. 22 is a functional block diagram of a speed control system that can be used in conjunction with a watercraft having the nozzle and nozzle deflector of the type illustrated in FIG. 21.

As shown in the functional block diagram in FIG. 22, in the speed control system 101 of the small planing boat 10 of this embodiment, the ECU 60 can have the "jet direction control unit" 125 as "jet direction control means" instead of the ignition frequency control unit 102, and the inclined angle control unit 126 as "inclined angle control means." The jet direction control unit 125 controls the boat body's resistance by moving the nozzle deflector 122 and changing the jet direction of the water based on the acquired output power value of the engine 19 acquired at the output power acquiring unit 101. Other features can be the same or similar to those of the first embodiment.

Figure 23A:
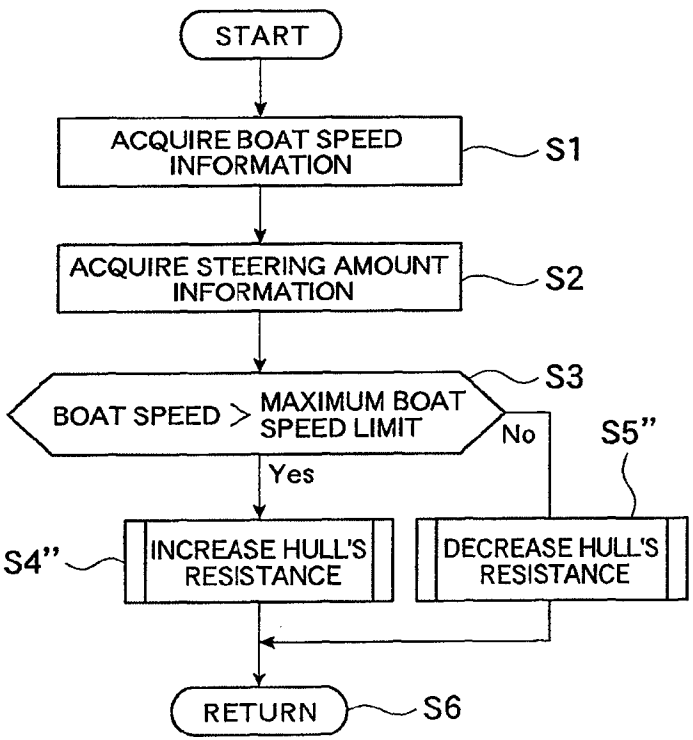
FIG. 23A is a flow chart showing a general procedure of a speed control using the speed control system of the small planing boat of FIG. 22.
Figure 23B:
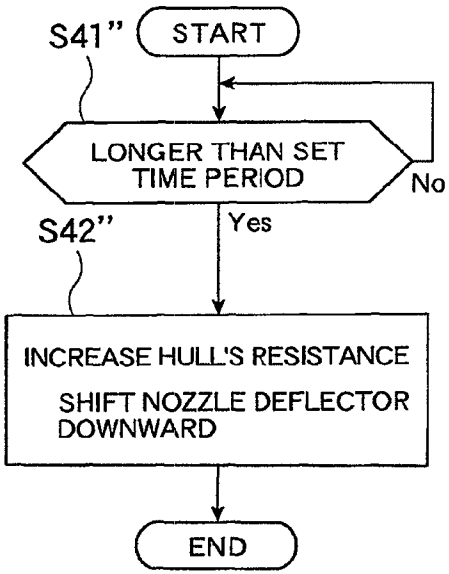
FIG. 23B is a flow chart of a control to increase the resistance of a boat body.
Figure 23C:
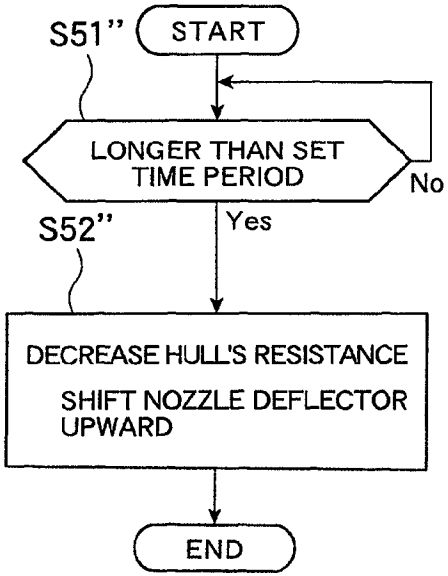
FIG. 23C is a flow chart of a control to decrease the resistance of the boat body.

The operational procedures of such embodiments, as shown in the flowchart in FIG. 23A, can be the same procedures of Steps S1 to S3 as that of the first embodiment. However, a control to increase the boat body's resistance (Step S4") can be carried out instead of the output power control (Step S4). For example, as shown in a flowchart shown in FIG. 23B, after the procedure of Step S41" (same as Step 41), the "resistance control means" changes the boat body's contact area with the water so as to perform a control to increase the boat body's resistance to the liquid (Step S42"). The increase in the boat body's resistance is performed by at least shifting the nozzle deflector 122 downward to change the jet direction of the water downward.

For example, the "output power control means" and the "resistance control means" of the ECU 60 perform following procedures of $a_7$ to $d_7$.

$a_7$: The revolution speed acquiring unit 63 acquires the surplus revolution speed value like the procedure of $a_1$.

$b_7$: The output power acquiring unit 101 acquires the surplus output power value of the engine 19 like the procedure of $b_1$.

$c_7$: The jet direction control unit 125 can perform a setting to increase the boat body's resistance based on the acquired surplus output power value of the engine 19. That is, the jet direction control unit 125 performs a setting to shift the nozzle deflector 122 downward. The setting can be performed such that the more the surplus output power value is, the more the shifting amount of the nozzle deflector 122 is set and/or the more another device is used to change the inclination of the hull. On the other hand, the setting can be performed such that the more the surplus output power value is, the longer the time period during which the nozzle deflector 122 is shifted or the longer another device is used to change the inclination of the hull.

$d_7$: The jet direction control unit 125 can make the nozzle deflector 122 shift downward for a certain time period by a set amount. In addition, when a stopping time period is set in $c_7$, the jet direction control unit 125 can make the nozzle deflector 122 shift downward by a certain amount for a set time period.

After the completion of the procedures of $a_7$ to $d_7$, the output power control (Step S4) is completed.

In addition, as shown in FIG. 23A of this embodiment, the control to decrease the boat body's resistance (Step S5") is performed instead of the control to restore the output power (Step S5). For example, as shown in the flowchart in FIG. 23C, after the procedure of Step S51" (same as Step S51), the "resistance control means" performs a control to change the contact area of the boat body 11 with the water to decrease the boat body's resistance to the liquid (Step S52"). The decrease in the boat body's resistance is performed by at least shifting the nozzle deflector 122 upward to change the jet direction of the water upward and/or other techniques for decreasing the boat body's resistance.

For example, the "output power control means" and the "jet pressure control means" perform the following controls of $e_7$ to $h_7$.

$e_7$: The revolution speed acquiring unit 63 acquires a surplus revolution speed value like the procedure of $e_1$ described above.

$f_7$: The output power acquiring unit 101 acquires the output power value of the engine 19 like the procedure of $f_1$ described above.

$g_7$: The jet direction control unit 125 can perform a setting to decrease the boat body's resistance based on the acquired insufficient output power value of the engine 19. In other words, the jet direction control unit 125 performs a setting to shift the nozzle deflector 122 upward. The setting is performed such that the larger the insufficient output power value is, the smaller the shifting amount of the nozzle deflector 122. On the other hand, the setting can be performed such that the larger the insufficient output power value is, the longer the time period during which the nozzle deflector 122 is shifted.

$h_7$: The jet direction control unit 125 and the inclined angle control unit 126 make the nozzle deflector 122 shift upward by a set amount for a certain time period. In the procedure of $g_7$ when the stopping time period is set, the jet direction control unit 125 can make the nozzle deflector 122 shift upward by a certain amount for a set time period.

After the completion of the procedures of $a_7$ to $d_7$ described above, the output power restoration control (Step S5) is completed.

As described above, in some embodiments, the "speed control means" is provided with the "resistance control means" for increasing the boat body's resistance to the liquid by changing the contact area of the boat body 11 with the water.

Therefore, the maximum speed of the small planing boat 10 can be surely kept below a predetermined speed without affecting substantially the driving state of the engine 19 because the boat body's driving speed can be decreased by changing the amount of the resistance of the boat body to the water which is a major factor in suppressing the driving force.

In some embodiments, the "resistance control means" comprises the nozzle deflector 122 which forms the front end portion of the nozzle 121 and changes the jet direction of the fluid by moving the nozzle deflector toward the vertical or horizontal direction with the drive of an actuator; the output power acquiring unit 101 to acquire by calculation etc. a surplus output power value in a current output power of the engine 19, over the output power of the engine 19 necessary to make the vessel speed of the small planing boat 10 reach a predetermined speed; and the jet direction control unit 125 which makes the resistance of the boat body to the liquid increase by changing the jet direction of the liquid downward and moving the nozzle deflector 122 based on the acquired surplus output power value. Accordingly, by the movement of the nozzle deflector 132, the jet direction of the water injecting from the nozzle 121 is changed and then the trim angle of the boat body 11 is changed. Therefore, the resistance of the boat body to the water can be increased, and the vessel speed can be surely kept below the set maximum speed.

In addition, in some embodiments, the direction of the nozzle deflector 122 can be designed to be controllable. The embodiments mentioned above can comprise the speed sensor 56 for detecting the vessel speed of the boat body 11; the speed information storing unit 62 on which the previously set maximum speed limit data of the boat body 11 is stored; the "speed control means" which performs a correlation between a vessel speed detected by the speed sensor 56 and the stored maximum speed limit stored on the speed information storing unit 62 and keeps the speed of the boat body 11 below the maximum speed limit based on the result of the correlation. Therefore, the speed control can be performed by the correlation between the detected real vessel speed and the previously set and stored maximum vessel speed limit, being able to realize an accurate speed control. In addition, the maximum vessel speed limit can be set by storing vessel speed data on the speed information storing unit 62 so that setting of vessel speed for each boat having a different shipping destination or the setting and adjustment of vessel speed for each small planing boat 10 can be carried out easily and accurately. And, the setting of the maximum speed limit can be carried out by setting data for each and every small planing boat 10, so that there is no need of setting a maximum speed control by increasing a resistance using a ballast weight etc. and there is no need to provide such configurations by which acceleration force is suppressed constantly and excessively. According to the present invention, the small planing boat 10 can have a distinguished accelerating performance by fully using the output power of the engine 19. The maximum vessel speed can be easily set for every boat having different shipping destination or sailing condition and the speed of the boat can be accurately kept below the set maximum speed.

In some of the embodiments mentioned above, the speed sensor 56 is a type of GPS type speed sensor, but at least one of a pitot tube type speed sensor or a paddle type speed sensor can also be used as a speed sensor instead of the GPS type sensor so that the speed sensor can be provided with simple structure and at low cost.

In some of the embodiments mentioned above, the speed control system of this invention is applied to a small planing boat 10, but the present speed control system can be applied to all transportation means using an internal combustion engine such as marine vessels, cars, two-wheeled motor vehicles, aircrafts etc. other than the small planing boat 10. It is noted that the embodiments of this invention is an exemplification and the present invention is not limited to the above mentioned embodiments.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means;

wherein the vessel speed control means comprises output power control means for controlling an output power of the internal combustion engine based on the result of the correlation; and wherein the output power control means comprises:

revolution speed detection means for detecting a revolution speed of the internal combustion engine;

surplus revolution-speed acquiring means for acquiring by calculation a surplus revolution speed value over the revolution speed of the internal combustion engine necessary to make the small planing boat reach the predetermined vessel speed, when the vessel speed exceeds the maximum speed limit as a result of the correlation; and revolution speed control means for controlling the revolution speed of the internal combustion engine based on the acquired surplus revolution speed value.

2. The vessel speed control system for a small planing boat according to claim 1, wherein the speed information storing means comprises a storage media on which the stored maximum speed limit data can be rewritten.

3. The vessel speed control system for a small planing boat according to claim 1, in combination with a small planing boat.

4. The vessel speed control system for a small planing boat according to claim 1, wherein the maximum speed limit is a maximum speed that a driver of the boat can achieve during normal operation of a boat controlled by the vessel speed control system while in an operator's area of the boat and with any user-adjustable systems of the boat adjusted for maximum speed.

5. The vessel speed control system for a small planing boat according to claim 1, wherein the speed detection means is a GPS type speed sensor.

6. The vessel speed control system for a small planing boat according to claim 1, wherein the speed detection means is a pitot tube type speed sensor and/or a paddle type speed sensor.

7. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means;

wherein the vessel speed control means comprises output power control means for controlling an output power of the internal combustion engine based on the result of the correlation;

wherein the output power control means comprises intake air mass amount control means for decreasing an amount of air mass flowing into a combustion chamber of the internal combustion engine; and wherein the intake air mass amount control means comprises:

an electronically-controlled throttle valve which is provided to an intake air passage through which air mass is supplied into the combustion chamber of the internal combustion engine and an opening degree of which is controlled by electronic means;

surplus air mass amount acquiring means for acquiring by calculation, a surplus air mass amount value, over an air mass amount to be supplied into the internal combustion engine necessary to make the small planing boat reach a predetermined vessel speed, when the vessel speed of the boat body exceeds the maximum speed limit as a result of the correlation; and throttle opening degree control means for decreasing an opening degree of the electronically-controlled throttle valve based on the acquired surplus air mass amount value.

8. The vessel speed control system for a small planing boat according to claim 7, wherein the vessel speed control system is provided with a valve position sensor for detecting an opening degree of the electronically-controlled throttle valve or the throttle valve, and the value of the air mass amount value to be supplied into the combustion chamber is decreased by decreasing the opening degree of the throttle valve based on a detected value of the valve position sensor.

9. The vessel speed control system for a small planing boat according to claim 7, wherein the speed detection means is a GPS type speed sensor.

10. The vessel speed control system for a small planing boat according to claim 7, wherein the speed detection means is a pitot tube type speed sensor and/or a paddle type speed sensor.

11. The vessel speed control system for a small planing boat according to claim 7, wherein the speed information storing means comprises a storage media on which the stored maximum speed limit data can be rewritten.

12. The vessel speed control system for a small planing boat according to claim 7, in combination with a small planing boat.

13. The vessel speed control system for a small planing boat according to claim 7, wherein the maximum speed limit is a maximum speed that a driver of the boat can achieve during normal operation of a boat controlled by the vessel speed control system while in an operator's area of the boat and with any user-adjustable systems of the boat adjusted for maximum speed.

14. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means, the vessel speed control means comprising output power control means for controlling an output power of the internal combustion engine based on the result of the correlation, the output power control means comprising intake air mass amount control means for decreasing an amount of air mass flowing into a combustion chamber of the internal combustion engine; and wherein the intake air mass amount control means comprises:

a bypass passage which is a passage provided separately from the intake air passage to which a throttle valve is provided and through which air mass flows into the combustion chamber, the bypass passage being branched from the intake air passage and bypassing the throttle valve to feed the air mass into the combustion chamber;

an electronically controlled valve for controlling an air mass flowing through the bypass passage, the air mass flow being controlled in accordance with an opening degree of the electronically controlled valve which is controlled by electrical means;

an actuator for driving the electronically controlled valve;

surplus air mass amount acquiring means for acquiring by calculation a surplus air mass amount value over the air mass amount to be supplied into the internal combustion engine necessary to make the small planing boat reach the predetermined vessel speed, when the vessel speed of the boat body exceeds the maximum speed limit as a result of the correlation; and electronically-controlled valve-opening-degree control means for decreasing an opening degree of the electronically controlled valve by driving the actuator based on the acquired surplus air mass amount value.

15. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means, the vessel speed control means comprising output power control means for controlling an output power of the internal combustion engine based on the result of the correlation, the output power control means comprising intake air mass amount control means for decreasing an amount of air mass flowing into a combustion chamber of the internal combustion engine; and wherein the internal combustion engine includes a supercharger disposed to an intake air passage, and wherein the intake air mass amount control means comprises:

a throttle valve provided in the intake air passage;

a second electronically controlled valve, provided at a position more downstream than that of the supercharger provided in the intake air passage, the second electronically controlled valve being configured to discharge a portion of air mass passing through the intake air mass passage into a space other than the combustion chamber when the second electronically controlled valve whose opening degree is controlled by electronic means is opened;

surplus air mass amount acquiring means for acquiring by calculation a surplus air mass amount value over an air mass amount to be supplied into the internal combustion engine necessary to make the small planing boat reach the predetermined vessel speed, when the vessel speed of the boat body exceeds the maximum speed limit as a result of the correlation; and second electronically-controlled valve-opening-degree control means for increasing the opening degree of the second electronically controlled valve based on the acquired surplus air mass amount value.

16. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means, the vessel speed control means comprising output power control means for controlling an output power of the internal combustion engine based on the result of the correlation, the output power control means being provided with ignition state control means for controlling an ignition state of the fuel into the combustion chamber of the internal combustion engine; and wherein the ignition state control means comprises:

surplus output power acquiring means for acquiring by calculation based on the result of the correlation, a surplus output power value in a current output power of the internal combustion engine over an output power of the internal combustion engine necessary to make the small planing boat reach the predetermined vessel speed; and ignition frequency control means for decreasing the number of ignition with respect to a revolution speed of the internal combustion engine, based on the acquired surplus output power value.

17. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means, the vessel speed control means comprising output power control means for controlling an output power of the internal combustion engine based on the result of the correlation, the output power control means being provided with ignition state control means for controlling an ignition state of the fuel into the combustion chamber of the internal combustion engine; and wherein the ignition state control means comprises:

surplus output power acquiring means for acquiring by calculation based on the result of the correlation, a surplus output power value in a current output power of the internal combustion engine over an output power of the internal combustion engine necessary to make the small planing boat reach the predetermined vessel speed; and ignition timing control means for retarding ignition timing of the internal combustion engine based on the acquired surplus output power value.

18. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means, the vessel speed control means comprising output power control means for controlling an output power of the internal combustion engine based on the result of the correlation, the output power control means comprising fuel feed state control means for decreasing a fuel feed amount to be supplied into the combustion chamber of the internal combustion engine; and wherein the fuel feed state control means comprises:

surplus output power acquiring means for acquiring by calculation based on the result of the correlation, a surplus output power value in a current output power of the internal combustion engine over an output power of the internal combustion engine necessary to make the small planing boat reach the predetermined vessel speed; and injection time period control means for decreasing an injection time period of fuel supplied into the combustion chamber of the internal combustion engine based on the acquired surplus output power value.

19. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means, the vessel speed control means comprising output power control means for controlling an output power of the internal combustion engine based on the result of the correlation, the output power control means comprising fuel feed state control means for decreasing a fuel feed amount to be supplied into the combustion chamber of the internal combustion engine; and wherein the fuel feed state control means comprises:

surplus output power acquiring means for acquiring by calculation based on the result of the correlation, a surplus output power value in a current output power of the internal combustion engine over an output power of the internal combustion engine necessary to make the small planing boat reach the predetermined vessel speed; and injection stop means for stopping the injection of fuel to the combustion chamber of the internal combustion engine for a predetermined time period based on the acquired surplus output power value.

20. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means;

jet pressure control means for decreasing the thrust force by controlling the jet pressure of the liquid jetted from the nozzle, wherein the jet pressure control means comprises:

a nozzle cone for controlling a pipe diameter of the nozzle, the nozzle cone being provided at a vicinity of a front end portion in an inner side of the nozzle and movable back and forth in a direction of a shaft of the nozzle by an operation of an actuator;

surplus output power acquiring means for acquiring by calculation based on the result of the correlation, a surplus output power value in a current output power of the internal combustion engine over an output power of the internal combustion engine necessary to make the small planing boat reach the predetermined vessel speed; and back-and-forth movement control means for decreasing the thrust force generated by the jet by moving the nozzle cone back and forth based on the acquired surplus output power value.

21. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means;

jet pressure control means for decreasing the thrust force by controlling the jet pressure of the liquid jetted from the nozzle, wherein the jet pressure control means is formed into such a shape that a diameter of a front end portion of the nozzle is increased or decreased by an operation of an actuator, and the jet pressure control means comprises:

surplus output power acquiring means for acquiring by calculation based on the result of the correlation, a surplus output power value in a current output power of the internal combustion engine over an output power of the internal combustion engine necessary to make the small planing boat reach the predetermined vessel speed; and front end diameter control means for decreasing the thrust force generated by the jet by increasing a diameter of the front end portion of the nozzle, based on the acquired surplus output power value.

22. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means; and jet pressure control means for decreasing the thrust force by controlling the jet pressure of the liquid jetted from the nozzle, wherein the jet pressure control means comprises:

a bypass passage, branched from the nozzle, for flowing a portion of the liquid flowing through the nozzle in a direction other than a direction along the front end portion of the nozzle;

a bypass valve, driven by an actuator, for controlling the flow rate of the liquid flowing through the bypass passage;

surplus output power acquiring means for acquiring by calculation based on the result of the correlation, a surplus output power value in a current output power of the internal combustion engine over an output power of the internal combustion engine necessary to make the small planing boat reach the predetermined vessel speed; and jet amount control means for decreasing the thrust force generated by the jet by increasing an opening degree of the bypass valve based on the acquired surplus output power value.

23. A vessel speed control system for a small planing boat for controlling a vessel speed of the small planing boat, a boat body of the small planing boat being driven by thrust force generated by jetting liquid from a nozzle supported by a portion of the boat body and driven by an internal combustion engine, the vessel speed control system comprising:

vessel speed detection means for detecting a speed of the boat body;

speed information storing means on which previously set maximum speed limit data of the boat body are stored;

vessel speed control means for controlling the speed of the boat body so as not to exceed the maximum speed limit based on a result of a correlation, the correlation being performed by correlating a speed detected by the vessel speed detection means with the maximum speed limit stored on the speed information storing means;

resistance control means for increasing a resistance of the boat body to the liquid by changing a water-contacting area of the boat body, wherein the resistance control means comprises:

a nozzle deflector, formed to be a front end portion of the nozzle and changeable in its attitude between vertical and horizontal positions by an operation of an actuator, for changing a jet direction of the liquid;

surplus output power acquiring means for acquiring by calculation based on the result of the correlation, a surplus output power value in a current output power of the internal combustion engine over an output power of the internal combustion engine necessary to make the small planing boat reach the predetermined vessel speed; and jet direction control means for increasing a resistance of the boat body to the liquid by changing the jet direction of the liquid downward by moving the nozzle deflector based on the acquired surplus output power value.

* * * * *